US007666077B1

(12) United States Patent
Thelen

(10) Patent No.: US 7,666,077 B1
(45) Date of Patent: Feb. 23, 2010

(54) PAINT BOOTH ARRANGEMENT AND METHOD FOR DIRECTING AIRFLOW

(75) Inventor: Richard L. Thelen, Eau Claire, WI (US)

(73) Assignee: Global Finishing Solutions, L.L.C., Osseo, WI (US)

( * ) Notice: Subject to any disclaimer, the term of this patent is extended or adjusted under 35 U.S.C. 154(b) by 153 days.

(21) Appl. No.: 11/985,017

(22) Filed: Nov. 13, 2007

(51) Int. Cl.
*B05B 15/12* (2006.01)

(52) U.S. Cl. ..... 454/50; 454/51; 454/53; 454/339

(58) Field of Classification Search ..... 454/54, 454/55, 50, 51, 52, 53
See application file for complete search history.

(56) References Cited

U.S. PATENT DOCUMENTS

| | | | | |
|---|---|---|---|---|
| 4,515,072 | A | 5/1985 | Crisp | |
| 5,063,835 | A * | 11/1991 | Rockx | 454/50 |
| 5,095,811 | A | 3/1992 | Shutic et al. | |
| 5,133,690 | A * | 7/1992 | Bowe | 454/51 |
| 5,136,857 | A * | 8/1992 | Odawara et al. | 62/263 |
| 5,284,518 | A | 2/1994 | Kohn | |
| 5,395,285 | A | 3/1995 | Milton | |
| 5,679,071 | A * | 10/1997 | Proctor | 454/52 |
| 6,533,654 | B2 * | 3/2003 | DeRegge | 454/52 |
| 2002/0119254 | A1 | 8/2002 | DeRegge | |
| 2006/0243202 | A1 | 11/2006 | Thelen | |

OTHER PUBLICATIONS

Thelen, Richard; Energy Reduction in Paint Booths; 2008; Global Finsihing Solutions.*
U.S. Appl. No. 10/563,044, filed May 8, 2006, Richard Thelen.

* cited by examiner

*Primary Examiner*—Steven B McAllister
*Assistant Examiner*—Brittany Towns
(74) *Attorney, Agent, or Firm*—Meroni & Meroni, P.C.; Charles F. Meroni, Jr.; Christopher J. Scott

(57) ABSTRACT

A paint booth arrangement maximizes floor space and efficiency of a painting operation. The arrangement comprises an equipment enclosing structure and certain air handling equipment specifically configured within the structure. The structure comprises forward and rearward sections, opposed wall sections, a centralized roof section, and opposed wall-to-roof sections, which sections define open space having varied elevation for receiving paintable equipment. The air handling equipment comprises an air intake and exhaust assemblies and an air replacement system. The air intake and exhaust assemblies extend coextensively intermediate the wall sections at the rearward section and function to support portions of the air replacement system. The air replacement system comprises conduit extending intermediate the forward and rearward sections as defined by the wall-to-roof sections. The air intake assembly communicates with the conduit for directing inlet airflow to the open space, and the air exhaust assembly comprises exhausts airflow from the open space.

30 Claims, 23 Drawing Sheets

PAINT BOOTH ARRANGEMENT AND METHOD FOR DIRECTING AIRFLOW

BACKGROUND OF THE INVENTION

1. Field of the Invention

The present invention generally relates to a paint booth construction. More particularly, the present invention relates to a paint booth arrangement and method for directing airflow through the paint booth for maximizing floor space and operational efficiency.

2. Brief Description of the Prior Art

Paint booths are used to enclose certain dangerous activities that are performed therein (such as painting and stripping) and to contain the risk of fire. Paint booths are further utilized to control the overspray from the spray paint guns and capture the paint particles that are not applied to the object being painted. Paint booths are designed in accordance with local and national electrical and fire codes and are usually surrounded with single or double skinned walls. Some of the more pertinent prior art relating to paint/spray booths and the like are briefly described hereinafter.

U.S. Pat. No. 4,515,072 ('072 Patent), which issued to Crisp, discloses a Spray Booth. The '072 Patent teaches a spray booth for use in spray painting motor vehicles, which booth comprises an air supply duct that extends centrally along the length of the top of the booth and has an air supply opening fitted with a cloth filter in its underside. The opening extends from near one end of the booth right up to the outer end and is supplied with air by a fan from the one end of the booth. A single air outlet opening is provided at the middle of the bottom of the one end of the booth and is connected to an air extraction fan. The velocity head of the air flow from the air supply fan decreases along the length of the air supply opening from the one end to the other and accordingly the pressure head increases so that the downward air flow from the filter cloth per unit length of the air supply opening decreases from the one end to the other end of the booth. This arrangement achieves an extremely efficient downward air flow pattern in the booth with little or no turbulence so that, after spraying, droplets of paint with which the air in the booth is contaminated after spraying are not precipitated on the surface which has been sprayed.

U.S. Pat. No. 5,095,811 ('811 Patent), which issued to Shutic et al., discloses an Automotive Powder Coating Booth with Modulated Air Flow. The '811 Patent teaches a method and apparatus of powder coating relatively large objects such as automotive or other vehicle bodies. The apparatus comprises a spray booth having an interior comprising a cut-in coating zone having a relatively large area to permit the application of powder onto the interior portions of the vehicle body such as the inner door flanges, a side coating zone area wherein the vertically oriented, exterior surfaces of the vehicle body are coated such as the doors and fenders, an overhead coating zone in which the horizontally oriented, exterior surfaces of the vehicle body are coated such as the hood, roof and trunk, and, two transition zones separating the three coating zones. Air infeed and exhaust devices associated with each coating zone and each transition zone are operated to vary the air flow rate within the booth interior in the course of movement of the vehicle body therethrough such that the air velocity in each coating zone is maintained below a predetermined maximum downdraft velocity throughout the coating operation, and such that a slightly negative pressure is maintained within the booth interior.

U.S. Pat. No. 5,284,518 ('518 Patent), which issued to Kohn, discloses a Recirculation Ventilation System for a Spray Booth. The '518 Patent teaches a spray booth ventilation system adapted for receiving long, slender work pieces suspended from an overhead monorail conveyor. The pieces are carried into and out of this booth, where the paint is applied by conventional equipment. The gases within the booth, which are a mixture of fresh air and evaporated paint solvents, are partially re-circulated and re-injected into the booth at discharge orifices defining the edges of the entrance of the booth. Arrangements are provided for equalizing the flow throughout the booth in a vertical direction to avoid points of stagnation which might cause fumes from the booth to emerge from the opening, so that the velocities of the inflow can be minimized to eliminate the danger of collision of the parts as they swing in response to the gas flow, and thus cause damage to the painted surfaces.

U.S. Pat. No. 5,395,285 ('285 Patent), which issued to Milton, discloses a Dehumidifier (for use in combination with a spray booth). The '285 Patent teaches system to dehumidify a substantially sealed chamber such as a spray chamber, which system comprises a re-circulating duct for re-circulating air within the chamber. The duct includes an exchange aperture facing the direction of flow of air. A fan to draw air through the duct is positioned downstream of the exchange aperture. A heater is provided preferably within the re-circulating duct and preferably located downstream of the display aperture.

U.S. Patent Application No. 2002/0119254, which was authored by Deregge, discloses an Integrated Air Flow Booth (and methodology). The publication describes a spray booth comprising a housing having a ceiling and a set of walls that each has a bottom end and a top end, with the walls and the ceiling defining an interior. An air intake is disposed in the ceiling, and an exhaust outlet is disposed near the bottom end of one the walls. A circulation system is used to introduce air into the interior through the intake and to exhaust air through the outlet. Further, the air intake is configured to produce an airflow gradient within the interior such that the flow rate decreases in a direction toward the outlet and such that the airflow through the interior is in a generally downward direction.

U.S. Patent Application Publication No. 2006/0243202, authored by R. L. Thelen, discloses an Aircraft Spray Booth, which invention is directed to an aircraft spray booth providing for effective removal of particulate matter, overspray and volatile organic compounds from the spray booth area without premature and uneven clogging of the filtration system. The invention is designed to create an accelerated airflow within the plenum of the spray booth to prevent or minimize stratification of the air and reduce particulate matter fallout. The airflow through the booth is increased by the reduction of the spray booth and filter area to approximately ⅓ of the original booth width. The decrease in the cross sectional area of the spray booth increases the overall speed of the airflow and decrease the volume of air exchanged through the booth. The spray booth is tapered at the reduction area to cause acceleration of the air at the sidewalls. The acceleration of air at the sidewalls causes a purging of air along the sidewalls and prevents paint and other particulate matter from adhering to the sidewalls. The reduction in the spray booth allows lighting can be placed closer to the painted surface in the tail and fuselage section of the aircraft to aid in the accuracy of the painting process.

It should thus be understood that paint booths typically comprise a filter section comprising a set of filter racks, a plenum, and a set of filters. The plenum is under a negative pressure caused by a fan, which ejects filtered airflow to the atmosphere. In order to properly clean/filter air to meet certain safety requirements, airflow velocity (speed and direction) in a paint booth is an important consideration. Airflow speed is usually held to be a constant and uniform rate (a common rate being 100 feet per minute) from the intake end of the booth to the exhaust end. In the conventional paint booth design, paint booth cross sectional area is constant from entrance to exhaust.

There are essentially two types of paint booths in the industry, namely so-called cross draft booths and downdraft booths. In cross draft booths the airflow is generally horizontal. In downdraft booths the airflow moves from the ceiling to a filter installed in the floor of the booth. Both types of paint booths are in common use in the industry.

Intake air to conventional paint booths typically arrives in one of two ways, namely a draw through style paint booth or a forced air style paint booth. In a draw-through style paint booth, intake air may be admitted to the painting environment through the open front of the booth or intake air may be admitted to the painting environment through a filtered door or doors consisting of door frames equipped with filter racks and filters in lieu of solid walls. The filter door style has the advantage of controlling the cleanliness of the air entering the booth. The open front style is only used where cleanliness is of moderate concern.

In the forced air style of paint booth, the intake air is forced into the booth through an intake air chamber consisting of a filter chamber, filter racks and filters. The advantage of this latter style of air intake is that the air may be pre-cleaned in the fan unit with one or two stages of filters and then cleaned once again at the intake chamber. This style assures the painter of best possible cleanliness of air entering his paint booth.

Paint booths are usually equipped with a fire protection system that may be dry chemical, foam or water based or a combination thereof. Paint booths must then be designed to support the piping for the fire protection system as well as the rest of the enclosure itself. Structural design is as important as any other phase of design including lighting and filtration and air moving.

SUMMARY OF THE INVENTION

If one were to examine a layout in cross sectional view of an aircraft paint booth, one would notice that considerable savings in energy can be accomplished by having the booth conform to the geometry of the aircraft being painted. To do this, there would be a centralized high roof section for the empennage equipment and two lower roof sections over the wing tips. The transverse cross sectional area may thus be reduced to a minimum. Since airflow velocity through a booth is directly related or dependent upon the cross-sectional area, the energy for heating and cooling the air in the booth may be significantly minimized if the booth is so tailored.

A primary objective of the present invention is to capitalize or improve upon the foregoing principle(s). The present invention attempts to place air handling units in line with or on each of the low roofs so as to maximize available floor space, reduce material costs, and enhance efficiency of the painting operation(s). In other words, if the air handling units can be placed in line with the dead space otherwise occupied by airflow enhancing geometry of the booth, the air handling units would not take up additional floor space and overall space savings may be accomplished.

Further, in cases of extreme cold weather or extreme warm weather, it may be desirable to include an energy recovery device (such as plate heat exchanger, glycol runaround coils, or heat wheel) to recover from the energy that is exhausted a portion of the heat that would be normally wasted. In this case air from the outside may preferably pass through a heat exchanger that transfers heat to the exhaust in the summer and takes heat from the exhaust in winter. This energy savings requires that ducts from the exhaust and supply systems interconnect. If the air handler is located remotely from the paint booth, these ducts can be very large. State of the art paint booth arrangements set forth remote mounting of air handlers with large space-occupying ducts. According to the present paint booth arrangement and method, the air handling units are located in close proximity to the exhaust and this space-occupying ducting may be significantly eliminated.

It is further noted that the placement of the heat exchanger in remote locations typically in the rear of the booth wherein air handlers may hang over the back of the booth and cause potential structural problems with ductwork elbows and the like causing a reduction in the available space. This invention proposes to pass to the rear of a standard booth another filter chamber to allow the fresh air from outside to enter and be cleaned/filtered prior to entering the heat exchanger.

Thus, the center part of the new filter chamber is for taking air from the rooftop intake units and channeling the air into a left and a right filter chamber. The air passes through the filter chamber from front to back and then rises up into the entrance of the air handler's heat exchanger. This arrangement saves space and is made possible by innovative channeling of air through an intake filter chamber.

The present invention promotes use of an air replacement unit as an alternate structural form. In this application, the shape of the air handler is defined by structural elements that form the edges of a rectangular unit. These structural elements also hold sidewall panels and lights for the paint booth, a function they would not ordinarily perform.

Since the air handlers are located at some height above the floor, means for supporting the units must be provided. Taking advantage of the high degree of structural strength already available in the twin exhaust and intake chambers of the present invention, the rearward sections of the air handling units are supported from underneath by intake and exhaust chambers. This support function of the air intake/exhaust assemblies provides a significant advantage when energy recovery system(s) are incorporated since most of the weight of an air handling unit so equipped is in the energy recovery device.

The front or forward sections of the air handling units are supported by hanging the units from structural steel beams. These beams are necessary in any case to hold the panels of the paint booth in place. Using them for the additional task of holding up the front of the air handlers accomplishes the unit support function with a small additional cost for heavier steel.

The low roof mounting of the air handlers allows yet another advantage. Normally a duct must run from the air handler discharge to the intake filter chamber of the paint booth. But in this case, the low roof and the side wall running up to the high roof already form two sides of a duct. It remains for a designer to close off the outer sidewall and the upper roof section thus forming the necessary ductwork at greatly reduced cost. This large cross sectional duct reduces air velocity therein and reduces noise. Moreover, the energy to force the air through the duct is less than when using conventional ducts.

By including the fresh air filter section at ground level most of the maintenance function of an air handler have been moved to grade level and can be easily accomplished without climbing steps with packages of filters. This adds to quick turnaround for maintenance as well as a safe workplace. It will be necessary to add a service platform and ladder to gain access to various maintenance points that cannot be reached from the ground.

BRIEF DESCRIPTION OF THE DRAWINGS

Other features of my invention will become more evident from a consideration of the following brief description of patent drawings:

FIG. 4(*b*) is a diagrammatic right side elevational type depiction of the paint booth arrangement according to the present invention with parts broken away to show an aircraft received within the arrangement.

FIG. 5(*b*) is a diagrammatic top plan type depiction of the paint booth arrangement according to the present invention with parts broken away to show an aircraft received within the arrangement.

DETAILED DESCRIPTION OF THE PREFERRED EMBODIMENT

Figure 1:
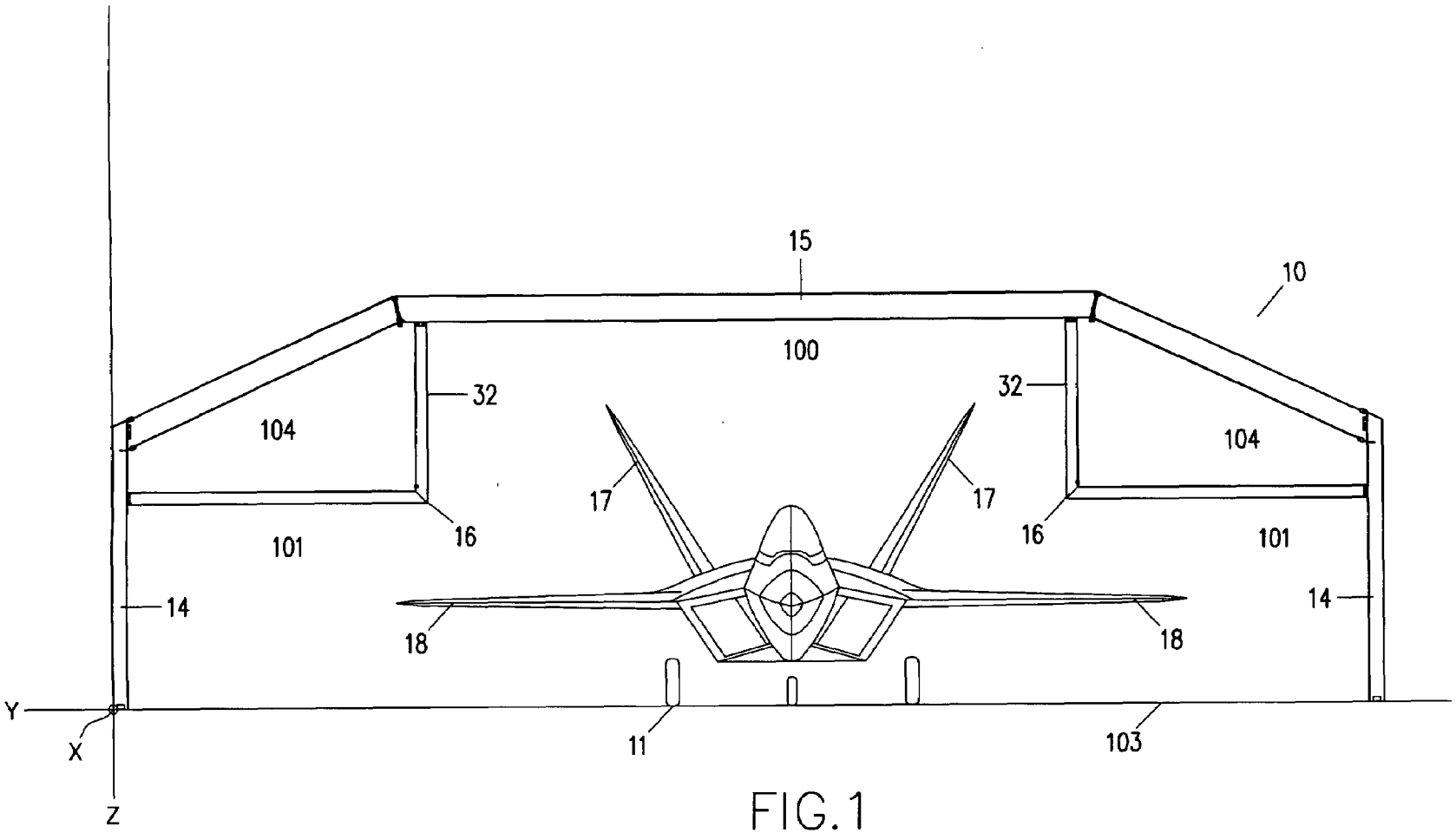
FIG. 1 is a first front plan type diagrammatic depiction of an aircraft received in a geometrically reduced cross section of a spray booth showing angled sections of an upper roof section.

Referring now to the drawings with more specificity, the preferred embodiment of the present invention concerns a paint booth structure and/or arrangement 10 specifically designed to maximize available floor space as well as overall efficiency of a painting operation. Although the paint booth arrangement or structure 10 according to the present invention is designed primarily for enclosing and enabling painting operations tailored for low observable aircraft, it is believed that the principles underlying the arrangement of the structure 10 may well be applied to any number of paint booth scenarios or situations in which paintable equipment are booth-received in order to be provided with protective coatings and the like. In other words, it is contemplated that other paintable equipment such as aircraft in general, land craft, and/or spacecraft may well benefit from the principles hereafter specified. Certain exemplary aircraft 11 are generally depicted and referenced in FIGS. 1-5.

The paint booth arrangement 10 or structure according to the present invention is further depicted and referenced in FIGS. 1-6, 19, and 20. The arrangement 10 essentially comprises an equipment-enclosing structure and certain air handling equipment specifically configured within the equipment-enclosing structure. The equipment enclosing structure is essentially a hangar type building and comprises a forward section 12 as referenced in FIGS. 4-6, 13, 19, and 20; a rearward section 13 longitudinally opposed to the forward section 12 as referenced in FIGS. 4, 5, 7, 14-17, 20, and 21; laterally opposed wall sections 14 as referenced in FIGS. 1-7, and 18-20; a centralized roof section 15 as referenced in FIGS. 1-6, 18, 19, and 21; and laterally opposed wall-to-roof sections 16 as referenced in FIGS. 1-3, 18, and 19.

It may be understood from an inspection of the noted figures that the centralized roof section 15 has a differing elevation as compared to the laterally opposed roof sections defined by the wall-to-roof sections 16. In other words, the centralized portions of roof section 15 comprise an elevation greater in magnitude than the elevation of the wall-to-roof sections 16 thereby defining laterally opposed lower roof sections and a centralized upper roof section. The resulting structure provides an equipment-receiving open space of varied height. In other words the space in inferior adjacency to the roof sections functions to receive paintable equipment having structural components with varied height. It is contemplated that the booth's essential support structure may be preferably fabricated from pre-drilled steel I-beams, to which may be attached pre-punched and companion flanged sheet steel panels. Said panels may bolt together for defining the side wall sections, ceiling sections, and rearward sections.

The forward section may be preferably outfitted with swing type intake plenum doors 19, which doors 19 may be preferably outfitted with, or bear high diffusion intake filters 36 and bubble seals around the perimeter. Notably, as recited, high diffusion intake filters are the preferred form of filtering means, but other types of filters and/or filtering means could well be incorporated into the design or otherwise utilized. The area(s) swept by swing doors 19 is referenced at 102 in FIGS. 5 and 21. Notably, the arrangement 10 may well be outfitted with alternative means for enabling ingress/egress of paintable equipment and the like, in addition to the exemplary doors 19. In this regard, it is contemplated that the invention could well function as outfitted with different door styles, including bottom rolling, fabric vertical roll-up, etcetera. Supply air can also be introduced from the front ceiling area via what is commonly referred to as "semi-downdraft" means.

Certain portions of the wall sections 14 may be further outfitted with manual access doors 45, observation windows 46, panic latches, utility niches 47, automatic roll-up product entry doors 48 with explosion proof operator(s), and/or other similar state of the art equipment or features. The roof section 15 and wall-to-roof sections 16 may be outfitted with lighting or light fixtures as at 33, which may be preferably defined by 48 inch fluorescent tube assemblies or the like as depicted and referenced in FIGS. 3 and 5(*a*).

Figure 2:
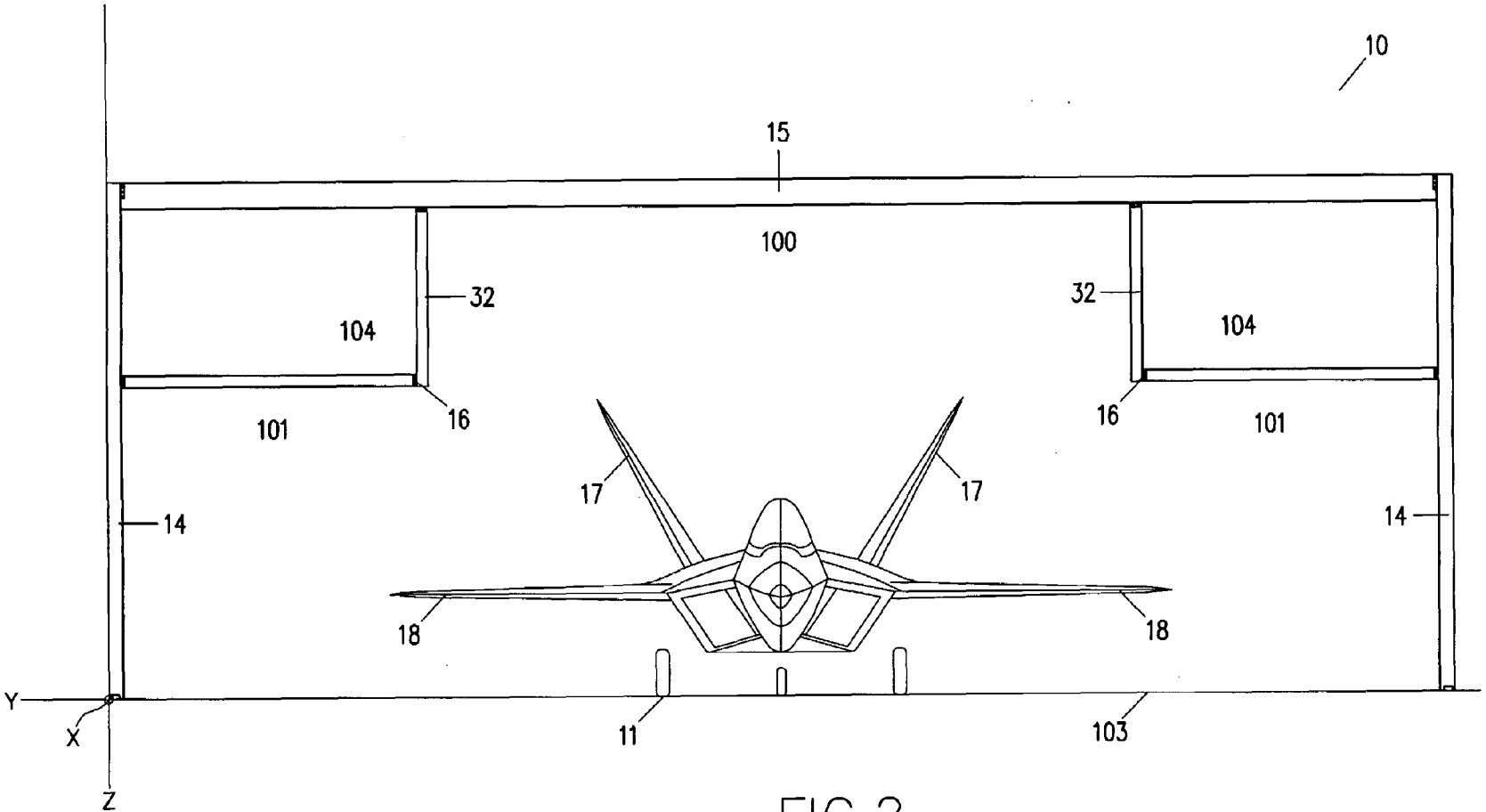
FIG. 2 is a second front plan type diagrammatic depiction of an aircraft received in a geometrically reduced cross section of a spray booth showing a substantially planar upper roof section.
Figure 3:
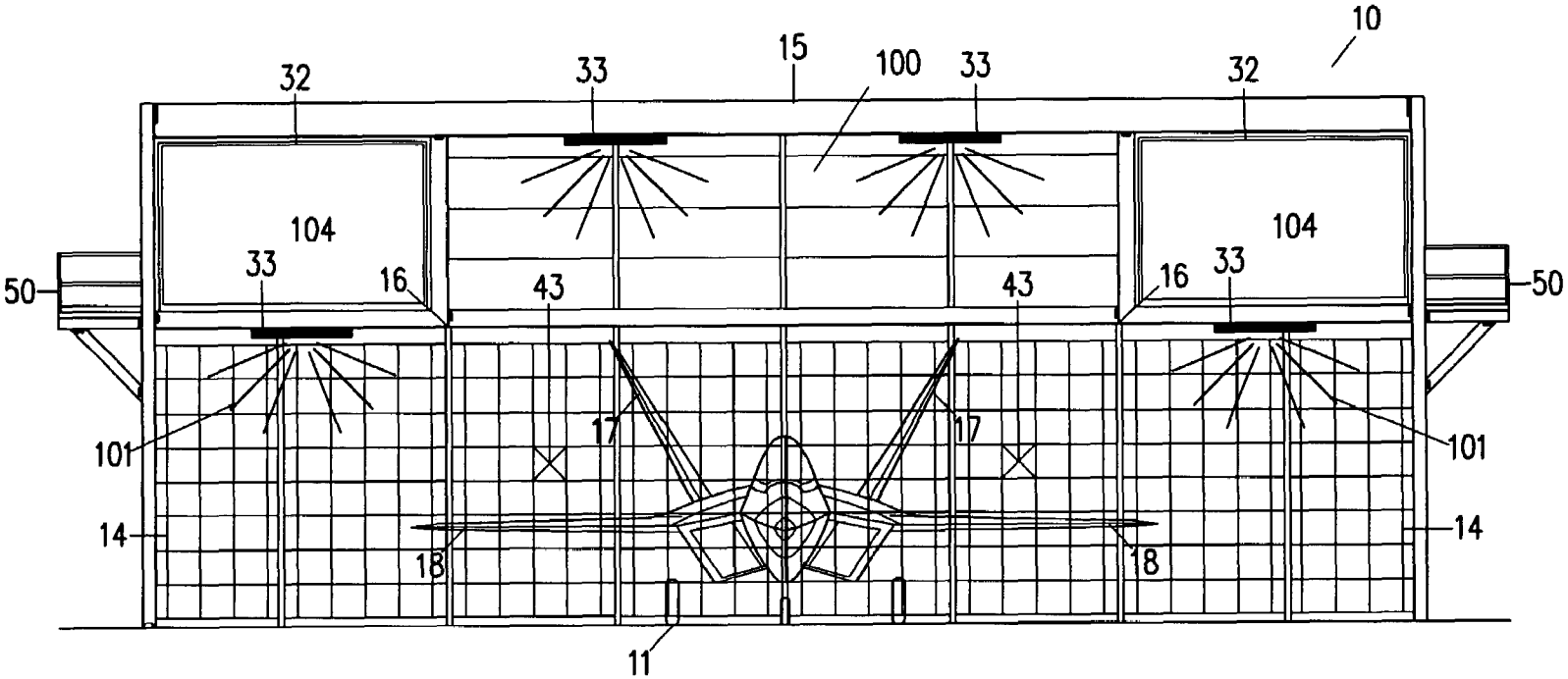
FIG. 3 is a detailed front plan type depiction of an aircraft received in a geometrically reduced cross section of a spray booth showing exhaust filter banks to the rear of the aircraft.

As has been noted, prior art cross draft paint booth applications teach or disclose transverse paint booth cross sections adapted for improving air flow characteristics through the paint booth structure or arrangement. In other words, the cross sectional area of a paint booth operation is typically reduced to minimize spacing intermediate the actual paint booth structure and the target equipment received within the booth as generally depicted in FIGS. 1-3. Referencing said figures, it may be seen, for example, that aircraft empennage sections 17 may be received in open spaces of greater elevation as at 100. The open spaces referenced at 100 may be preferably situated intermediate laterally opposed roof sections of reduced elevation as defined by the wall-to-roof sections 16. Aircraft wing sections 18 may thus be received in the open spaces referenced at 101 underneath or inferior to the laterally opposed roof sections 16 of reduced height.

Air flow through the open spaces 100 and 101 defined by the non-uniform roof structures is thereby enhanced according to state of the art principles. The present invention improves upon this feature by placing bulky air handling equipment in line with the otherwise unoccupied space defined by the wall-to-roof sections 16, which sections 16 function to configure the non-uniform roof structure as means to aid the cross draft airflows. Many spray booth operators operate on the basis of having a minimum airflow velocity of 100 feet per minute, for example. Airflow rates falling below this velocity may well operate to extract vapors, but may not be sufficient to carry particulates within paint overspray to the airflow exhaust filters. Thus, airflow velocity is one critical factor. However, it is further noted that airflow velocities at or above a standardized effective velocity may also prove ineffective at carrying particulates to the airflow exhaust filters if the paint booth structure is improperly designed.

Air handling equipment and paint booth structure thus go hand-in-hand to provide effective paint booth operations. The present invention attempts to capitalize or improve upon the foregoing concepts as a means to effect better particulate movement to exhaust filters via cross drafting with maximized floor space and operational efficiency. As earlier noted, a primary underlying problem being addressed by the present invention is that paint booth space (whether floor space or space for receiving air handling equipment) is often limited. Thus, it was conceived that if air handling equipment could be placed in line with the dead or unoccupied space otherwise defined by non-uniform roof structures (which structure is designed for enhancing cross draft air flow), more efficient use of paint booth space could be achieved. Portions of the air handling equipment according to the present invention may thus be preferably placed in line with the non-uniform roof structures, while other portions of the air handling equipment may preferably provide certain load-bearing support for the so-called inline air handling equipment.

Figure 8:
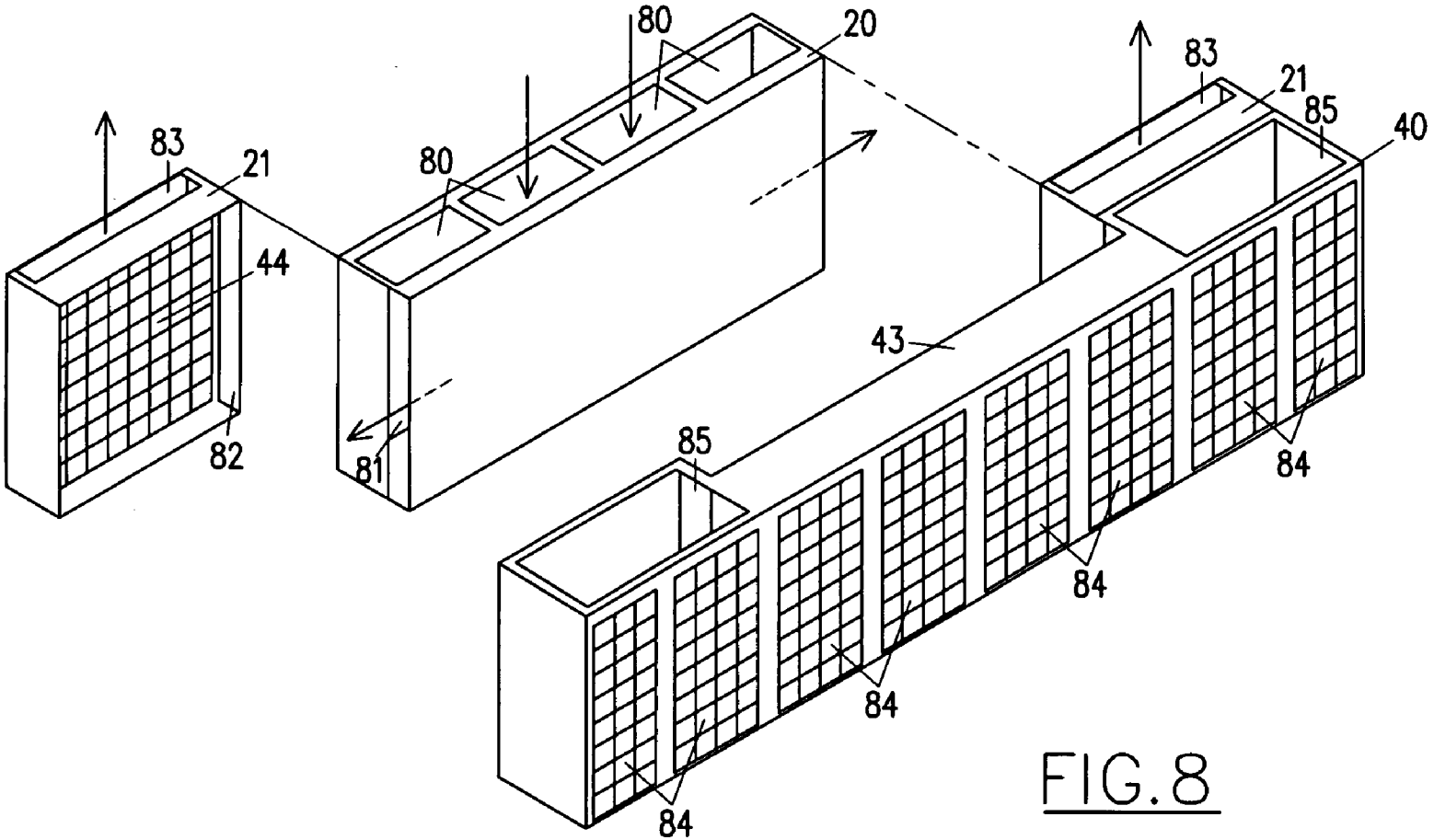
FIG. 8 is an exploded perspective view of an air intake/exhaust complex according to the present invention.
Figure 9:
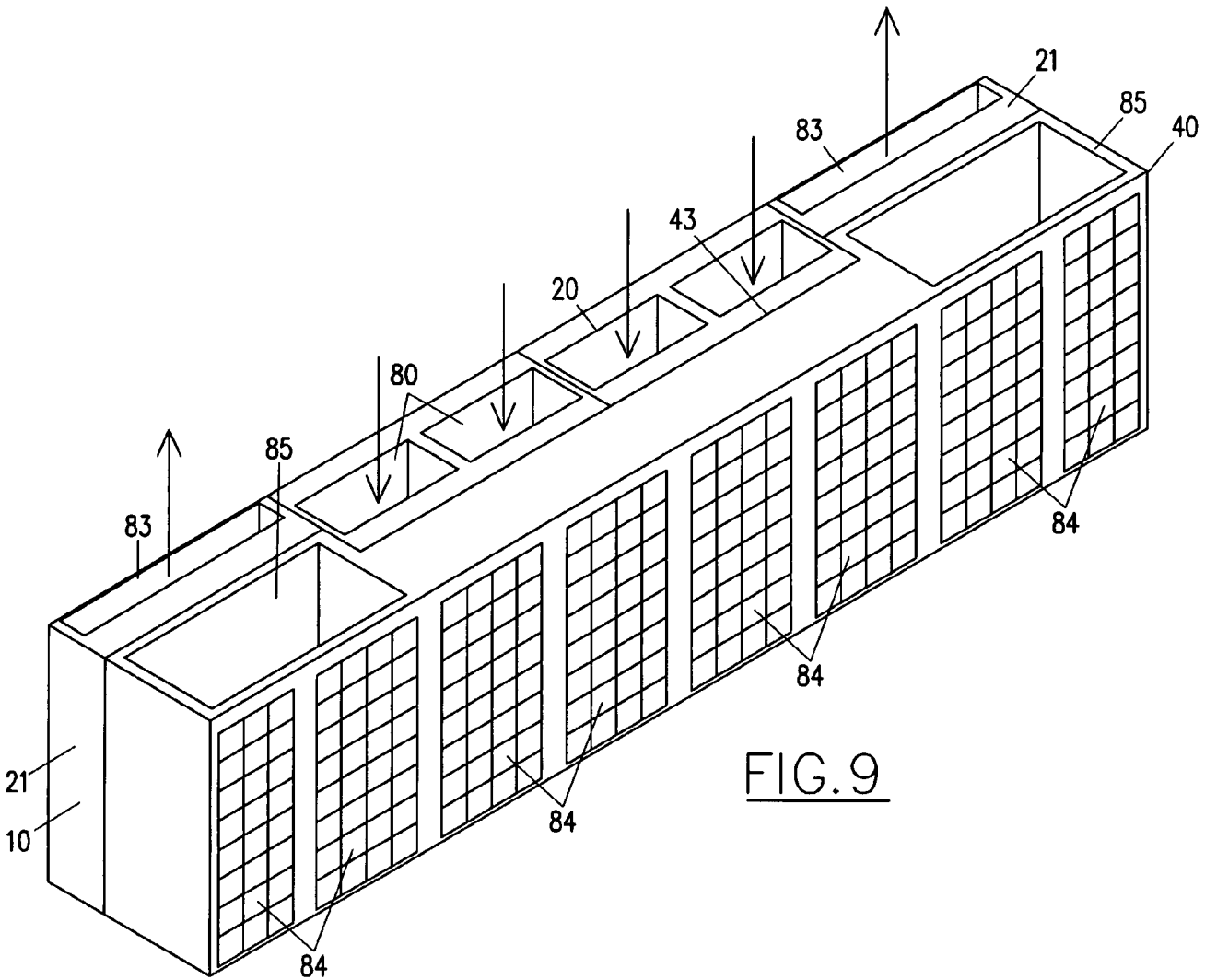
FIG. 9 is an assembled perspective view of the air intake/exhaust otherwise shown in FIG. 8.

The air handling equipment according to the present invention may thus be said to comprise an air intake assembly, an air exhaust assembly, and an air replacement system all of which are in communication with one another. The air intake assembly may be said to preferably comprise a centralized fresh air plenum 20 as depicted and referenced in FIGS. 8, 9, and 18; and laterally opposed filter banks 21 in communication with the plenum 20. When assembled, the filter banks 21 and the air plenum 20 may be said to form an air intake complex as generally depicted at 70 in FIGS. 9 and 13-18. The filter banks 21 are dually depicted and referenced in FIGS. 9 and 18, and the outside of a single filter bank 21 is referenced in FIGS. 13 and 20.

Outside fresh air is taken into the system via ducts 22 (preferably outfitted with a louvered penthouse 31) as referenced in FIGS. 13 and 18-20, which inlet airflow is directed downwardly to the plenum 20 via ducts 22 and inlet into the plenum chamber 20 via plenum inlets 80. Once the outside air enters the plenum 20 it is divided or diverted laterally into the filter banks 21 via plenum outlets 81 and bank inlets 82. As the filtered airflow leaves the filter banks 21 via bank outlets 83, the airflow is directed upwardly to dual air handling units or air makeup units (AMU's) 30, which AMU's are depicted and referenced in FIGS. 4, 5, 7, 10-17, and 20. (The airflow through the air intake complex 70 is generally depicted at vector arrows in FIGS. 8 and 9). It should be noted from an inspection of certain of the figures that the filter banks 21, in addition to providing a fresh air filtering function, provide certain load-bearing support for the laterally opposed AMU's 30.

Figure 10:
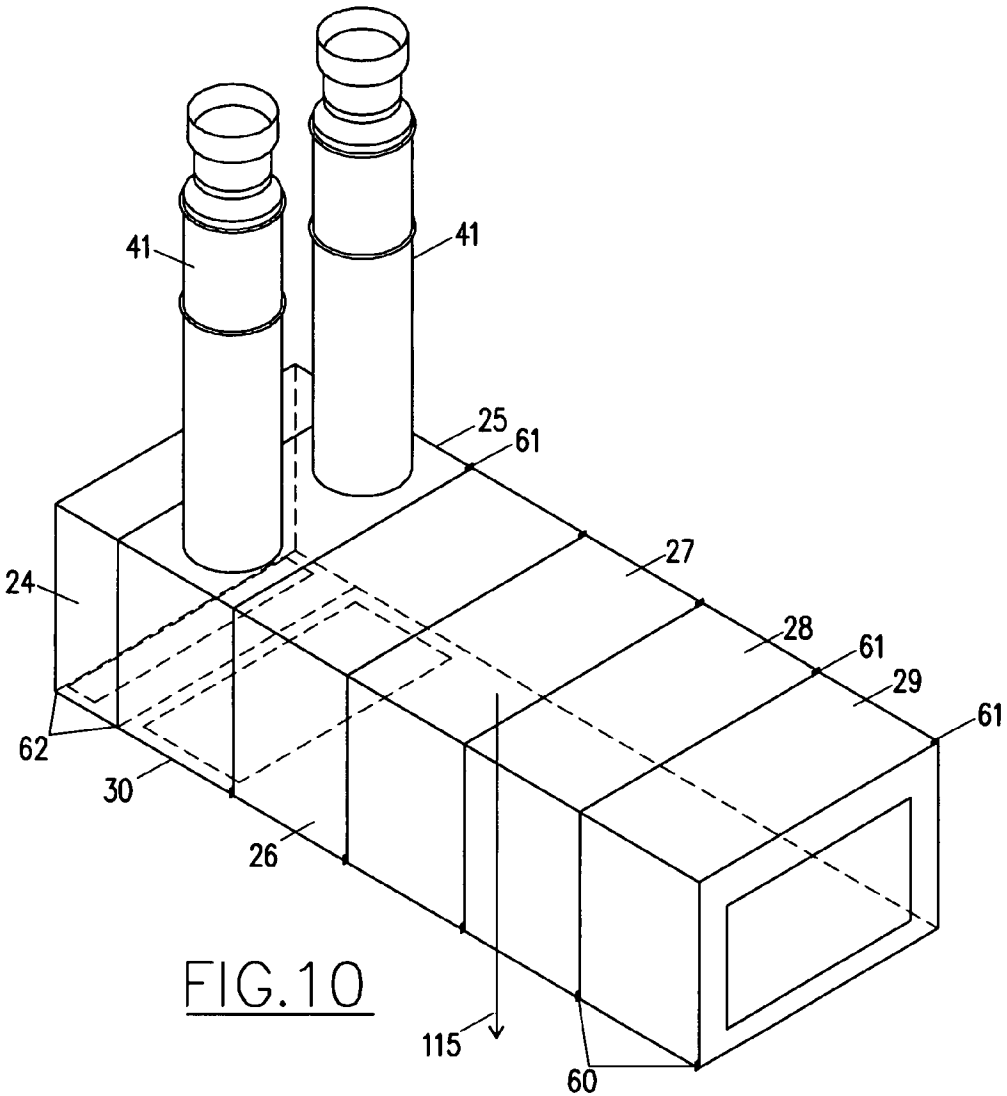
FIG. 10 is a perspective view of an air handling unit according to the present invention outfitted with exhaust ducts adjacent a rearward portion thereof.
Figure 15:
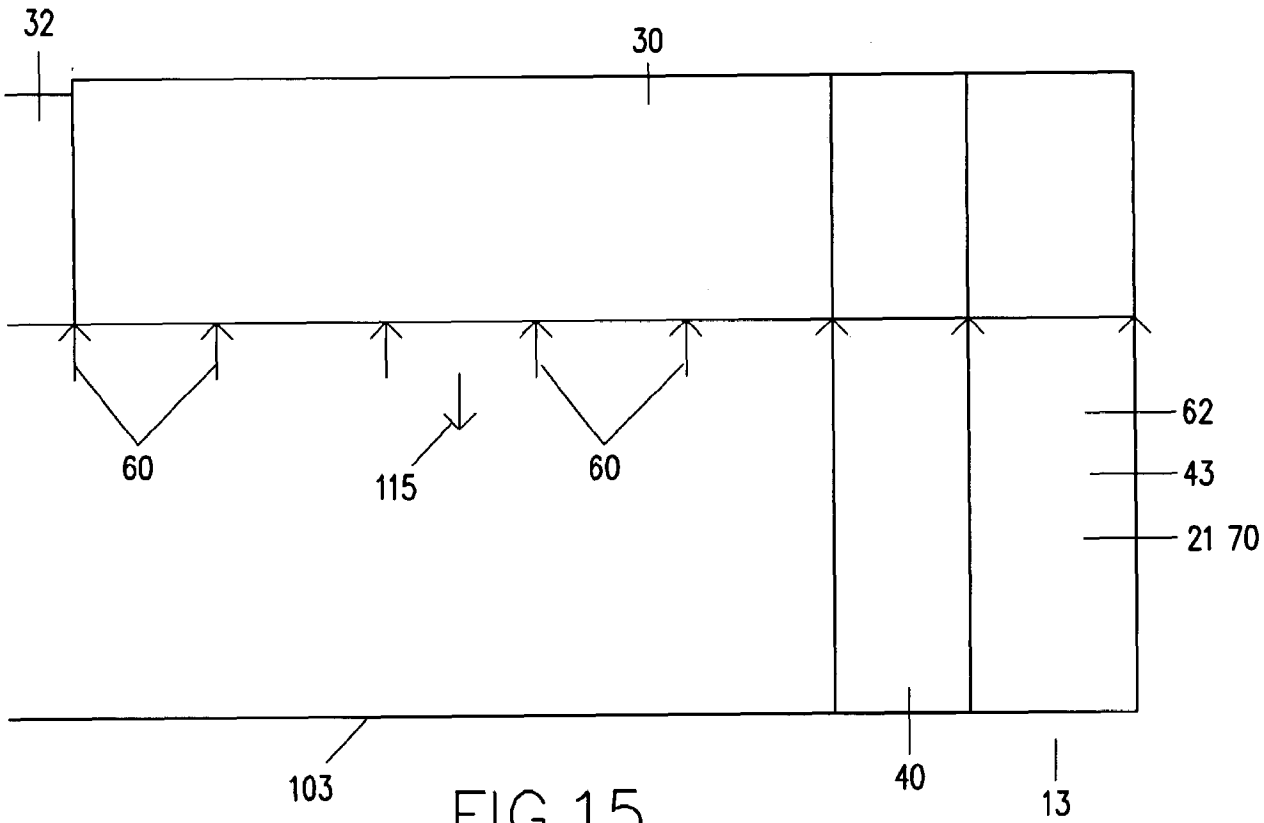
FIG. 15 is a fragmentary, enlarged, diagrammatic side view type depiction of an air handling unit being supported by the air intake-exhaust complex and wall section support structures.
Figure 16:
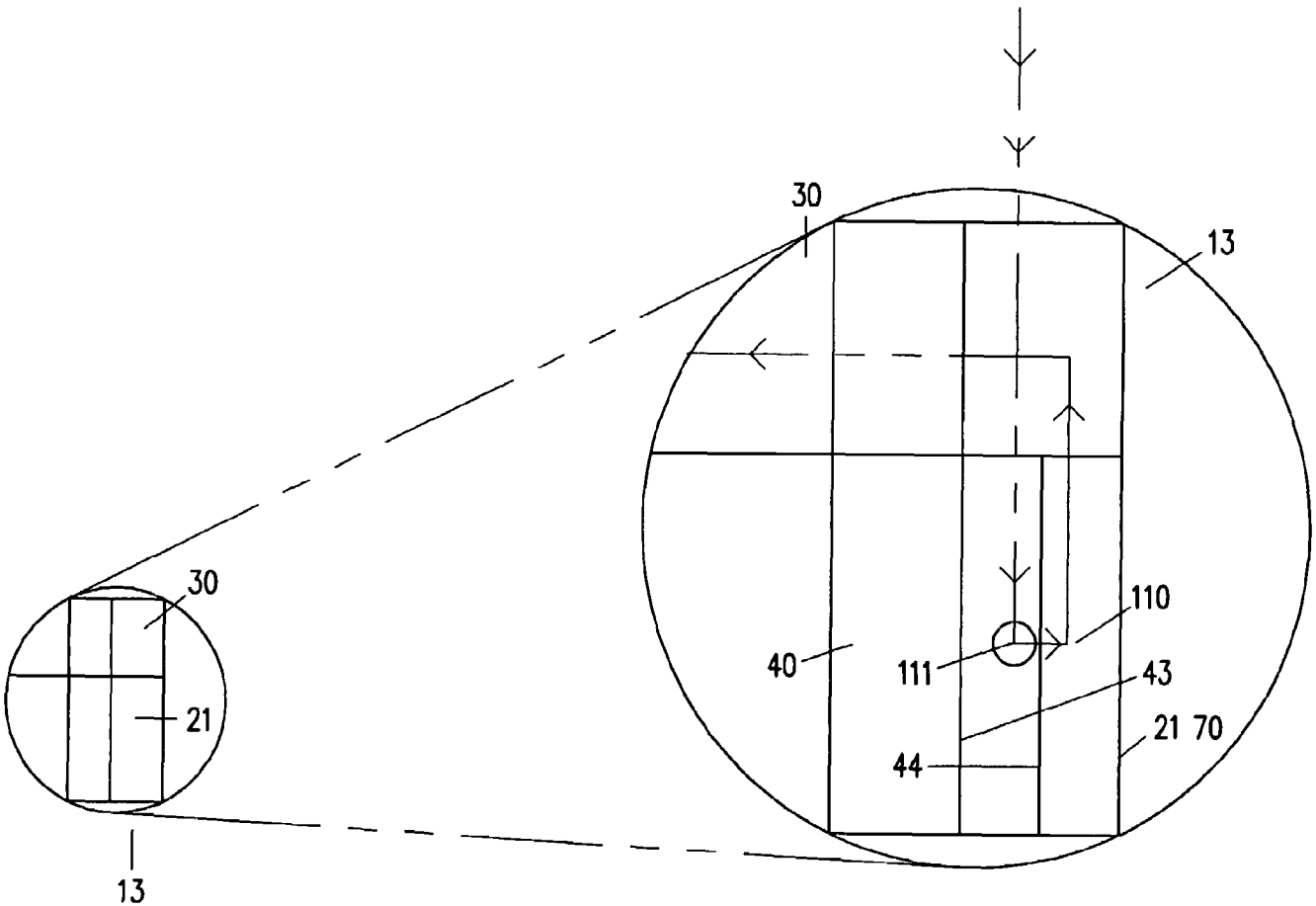
FIG. 16 is a fragmentary, enlarged, diagrammatic sectional view type depiction of the generalized airflow path through the paint booth arrangement at the rearward section showing airflow toward the reader within the air intake portion of the air intake-exhaust complex.
Figure 17:
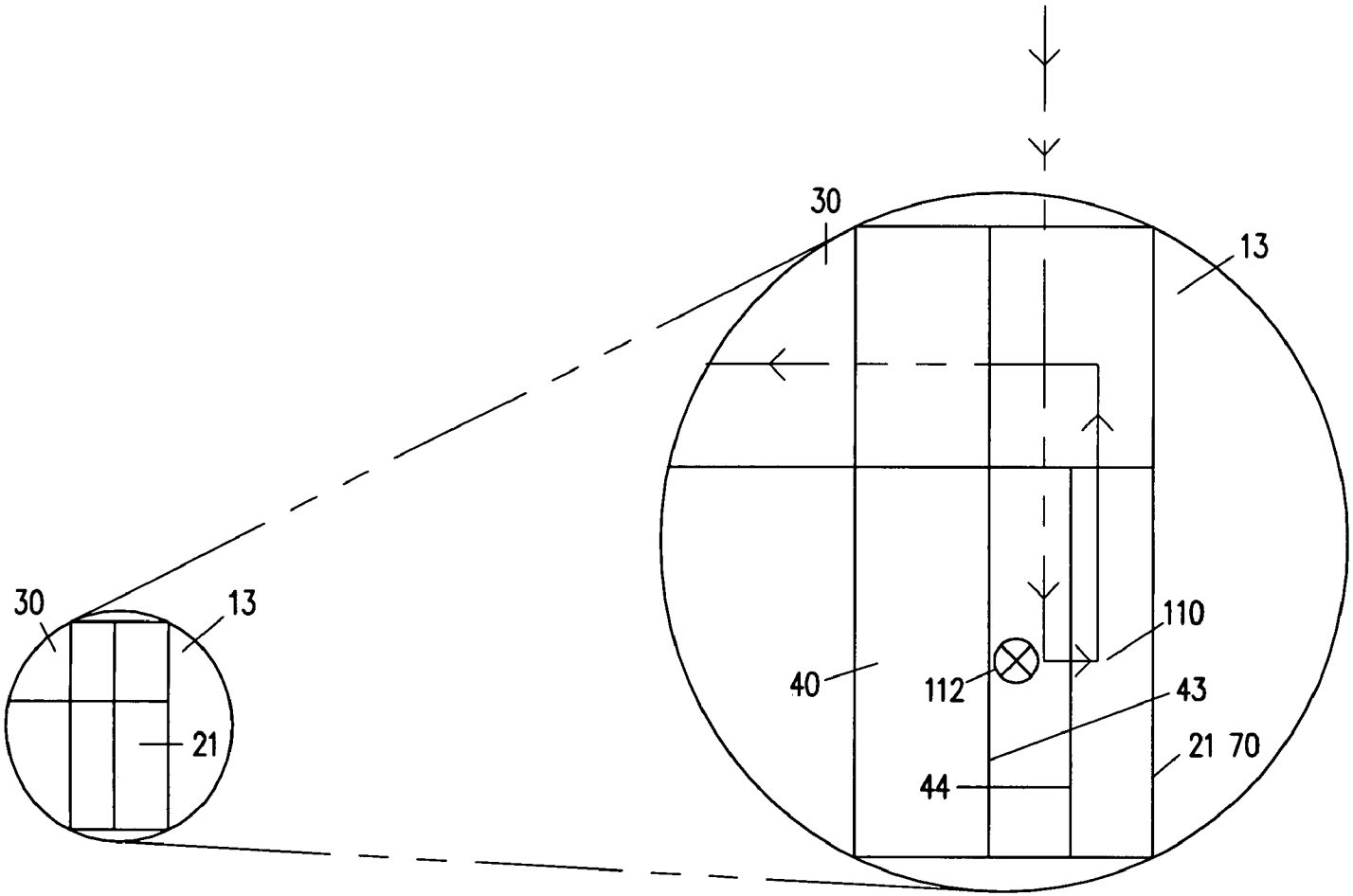
FIG. 17 is a fragmentary, enlarged, diagrammatic sectional view type depiction of the generalized airflow path through the paint booth arrangement at the rearward section showing airflow away from the reader within the air intake portion of the air intake-exhaust complex.
Figure 18:
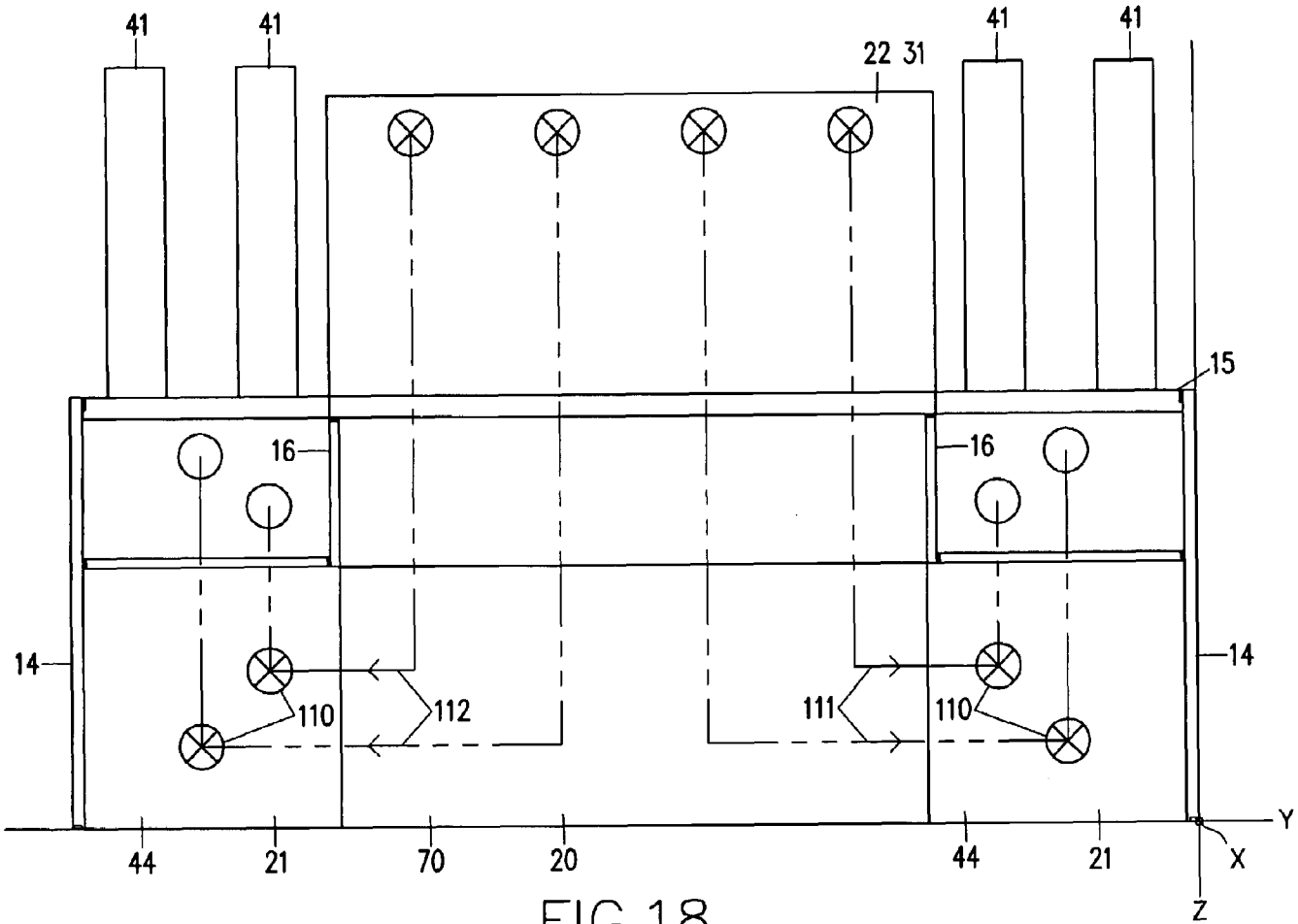
FIG. 18 is a diagrammatic sectional front view type depiction of the paint booth arrangement with air exhaust portion of the air intake-exhaust complex removed to show the generalized airflow intake in three dimensions.

In this last regard, it may be seen from a particular inspection of FIGS. 13-17 and 20 that the filter banks 21 provide AMU load (115)-bearing support for the rearward portions of the AMU's 30 as at vector arrows 62 in FIGS. 10 and 15. It is noted that state of the art filter banks 21 are typically robust structures which may be used to provide load-bearing support as situated intermediate loads and ground support structure 103 in FIG. 15. Such load-bearing quality is here being incorporated into the design of the arrangement 10 as a means to provide load-bearing support for the laterally opposed AMU's 30 and to otherwise maximize available floor space.

Notably, however, the structural steel of the roof or canopy sections may also function to directly support the AMU's 30.

It is contemplated that the advantage of supporting the AMU's both from lower load-bearing material and upper load-bearing material, is that the depth of the lower load-bearing material could be reduced substantially. In other words, it is contemplated that the lower steel may extend approximately 16 feet if it alone supported the AMU's, whereas if the AMU's were suspended, the lower steel may only extend approximately 6 feet. Forward portions of the AMU's 30 may be supported by I-beam type support structures of the wall sections 14 as at vector arrows 60 in FIGS. 10 and 15, as well as by support structures of the roof section 15 as at vector arrows 61 in FIG. 10.

Notably, an air handling unit (AHU) is a device used to condition and circulate air as part of a heating, ventilating, and air-conditioning (HVAC) system. Usually, an air handling unit is housed within a large metal box containing a blower, certain heating and/or cooling elements, filter racks or chambers, sound attenuators, and dampers. In this case, it is contemplated that in addition to the foregoing, the air handling units (AHU's) or air makeup units (AMU's) 30 may preferably comprise certain energy recovery means or systems for maximizing efficient use of thermal energy passing through or within the arrangement 10.

It is thus contemplated that the energy recovery means may be exemplified by such devices as a plate heat exchanger, glycol runaround coils, or heat wheel to recover energy that is taken in or exhausted as heat that would otherwise be untapped. As earlier stated, airflows may pass through a heat exchanger, which heat may transfer to the exhaust in warmer summer time temperatures, and be drawn from the exhaust in cooler winter timer temperatures. Energy savings from this type of system require that ducts from the exhaust and supply systems interconnect. If the air handling unit is located remotely from the paint booth, the interconnecting ducts can be very large and space-occupying. Indeed, state of the art air handling systems typically incorporate remote mounting of air handlers, which require said large space-occupying ducts. The present invention places the air handling units (AHU's) or air make-up units (AMU's) 30 in close proximity to exhausting (and inlet) airflows and no such ducting is otherwise required, thereby maximizing space efficiency.

Figure 11:
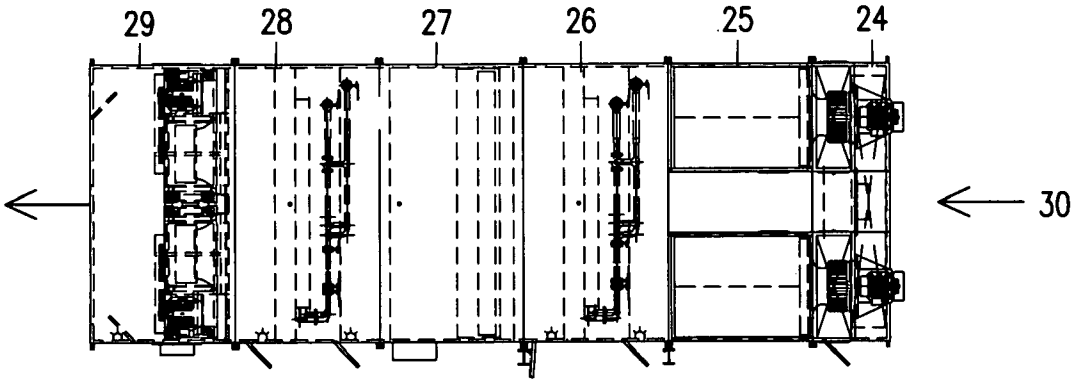
FIG. 11 is a top view type depiction of the air handling unit according to the present invention depicting six air handling sections with certain parts broken away to show otherwise hidden structure.
Figure 12:
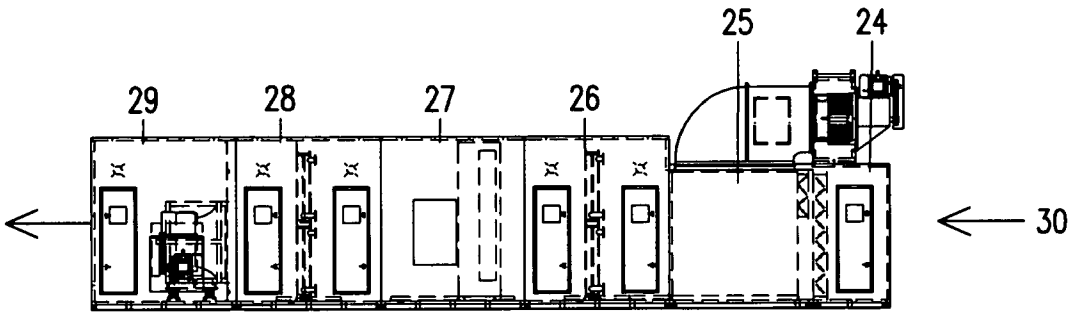
FIG. 12 is a side view type depiction of the air handling unit according to the present invention depicting six air handling sections with certain parts broken away to show otherwise hidden structure.
Figure 13:
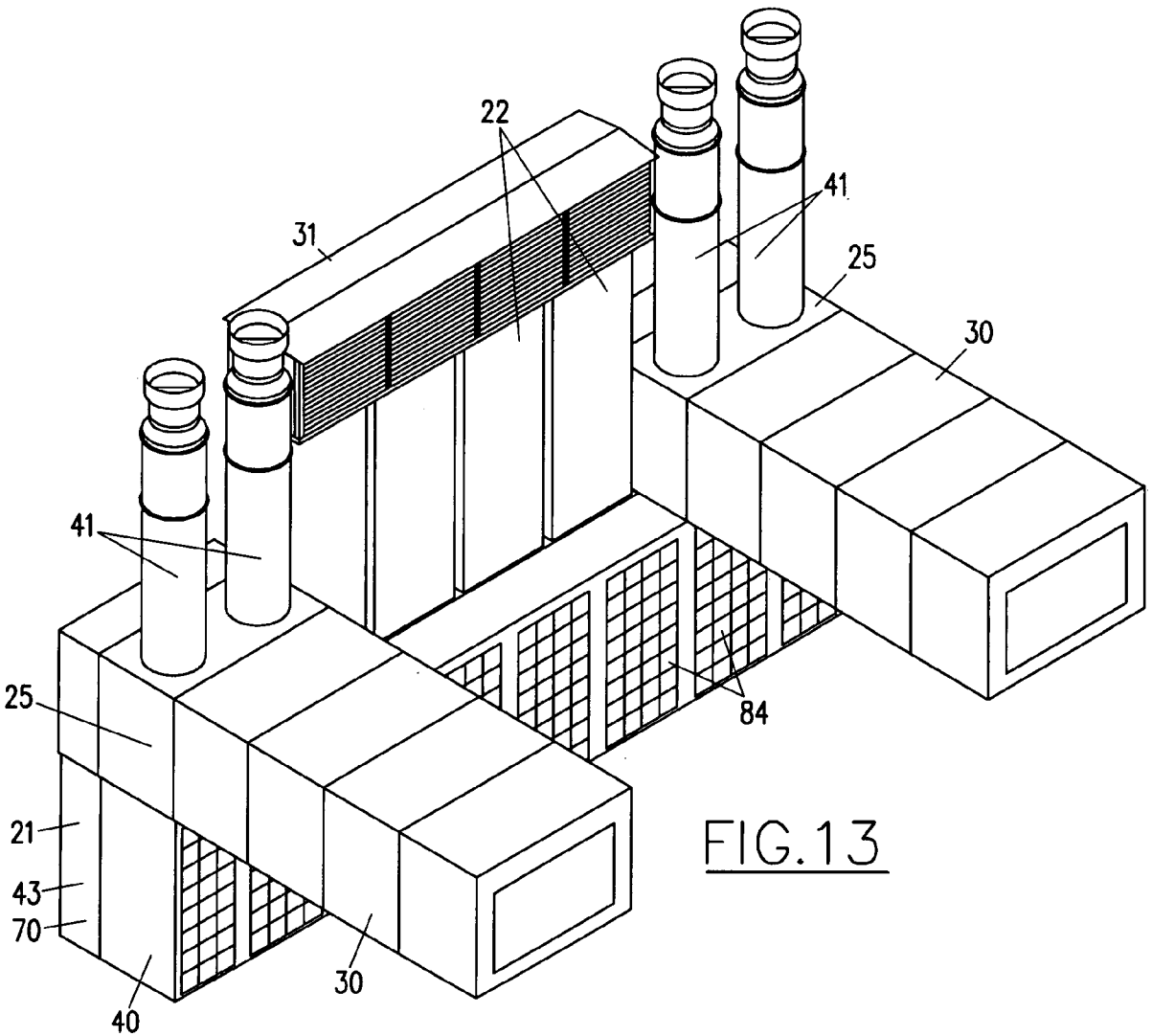
FIG. 13 is a top perspective view of the air intake-exhaust complex supporting laterally opposed air handling units outfitted with exhaust ducts and a centralized, louvered air intake assembly for directing air into the air intake chambers of the air intake-exhaust complex.
Figure 14:
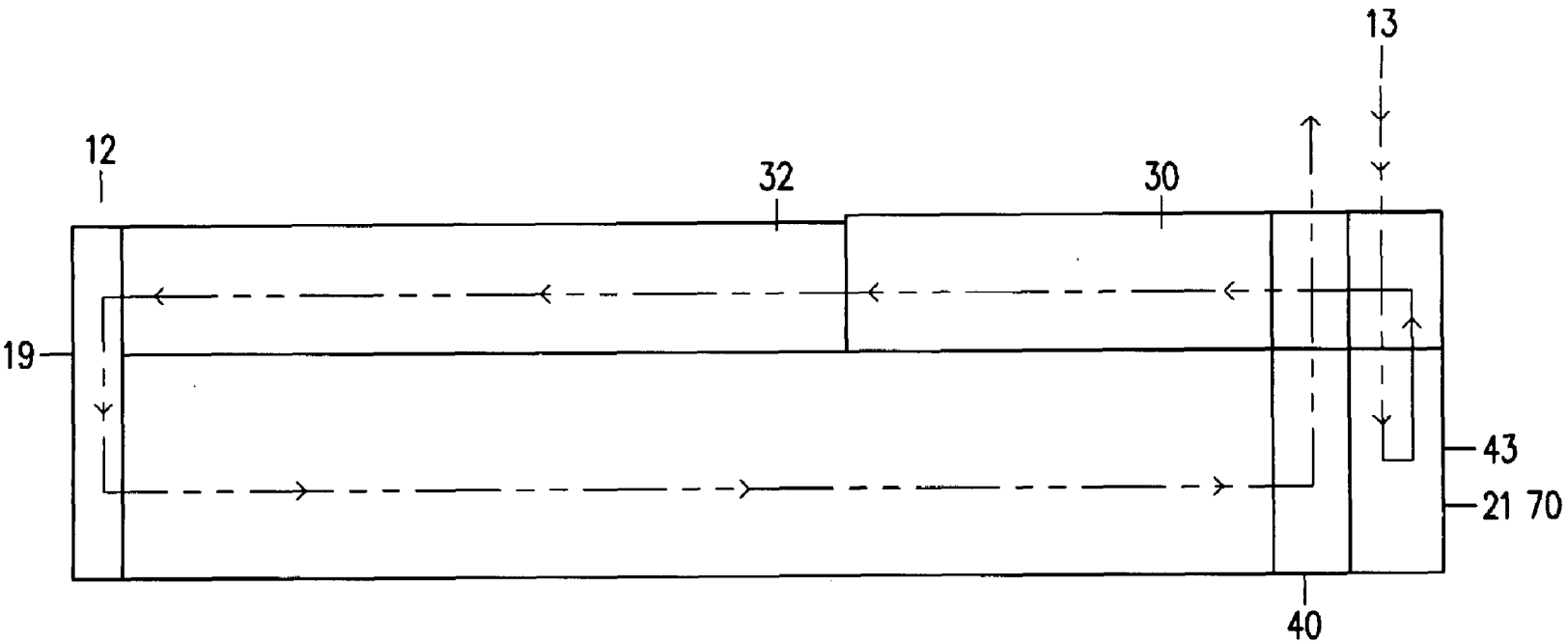
FIG. 14 is a diagrammatic side view type depiction of the generalized airflow path through the paint booth arrangement in two dimensions.

Referencing FIGS. 10-12, it is contemplated that the AMU's 30 according to the present invention may preferably comprise a fresh or outside air intake section 24, an energy recovery cell section 25, a hot water preheat section 26, an evaporative humidifier section 2, a secondary hot water coil section 28, and a blower section 29 for supplying air to ductwork 32 for further supplying the plenum doors 19. It should perhaps be noted here that AMU's 30, comprising a variety of elements as housed within the foregoing exemplary sections, require frequent and regular maintenance.

In this regard, the paint booth arrangement 10 may be preferably outfitted with certain maintenance enhancing or enabling structure(s) such as cat walks, railings, and ladders adjacent the wall sections 14 and rearward section 13 as depicted and referenced at 50 in FIGS. 3-5, 7, and 21. From an inspection of FIG. 21, it may be seen that if a plurality of paint booth arrangements 10 were situated in back to back, and/or side by side relation, maintenance costs could effectively be reduced by placing the equipment of multiple arrangements in close proximity to one another and reducing transit time between maintenance sites. Further, the AMU's 30 may be equipped with access panels or booths 49 that double as skins for the booth arrangement 10 at that site. In other words, the removable panels of the AMU's 30 (otherwise enabling maintenance of internal equipment) may well double as portions of the wall sections 14 thereby further reducing material costs of the arrangement(s).

It is further contemplated that in order to save material cost and space, two runs of ductwork 32 may be preferably defined, in part, by the laterally opposed wall-to-roof sections 16. The wall-to-roof sections 16, in combination with laterally opposed wall sections 14 and the roof section 15, complete the ductwork 32 as depicted and referenced in FIGS. 1-3, 6, 14, 15, and 20. From a comparative inspection of the noted figures, it may be understood that the sections 14, 15, and 16 form a continuous conduit or duct 32 through which supply air for the plenum doors 19 may convey as aided by the blower sections 29. The laterally opposed wall-to-roof sections 16 form laterally opposed ceiling or roof portions of reduced height, through which ceiling space (as at 104) forced supply air may convey to the plenum doors 19. It is contemplated that the junction intermediate the plenum doors 19 and the duct runs 32 at the forward section 12 may be preferably outfitted with rubber seals in order to effect a tighter seal and effect enhanced airflows.

Airflow then enters the open spaces 100 and 101 of varied elevation via the plenum doors 19 for carrying overspray particulates and vapor toward certain exhausting means at or adjacent the rearward section 13. It will be recalled that the arrangement 10 is provided with an exhaust assembly, which exhaust assembly preferably comprises a three stage National Emissions Standards for Hazardous Air Pollutants (NESHAP) filtration system or air exhaust complex 40 as illustrated and referenced in FIGS. 3, 8, 9, 13-17, and 19. The system or complex 40 may preferably comprise a first stage of roll media, a second stage of panel filters, and a third stage of pocket bag filters as summarily represented by inlet filters 84. The complex 40 may share a common wall (as at 43), and extend coextensively, with the plenum 20 and filter bank(s) 21 or air intake complex 70 intermediate the wall sections 14 for providing further load-bearing support for the AMU's 30 (forward of the filter banks 21) as generally depicted in the noted figures.

Figure 19:
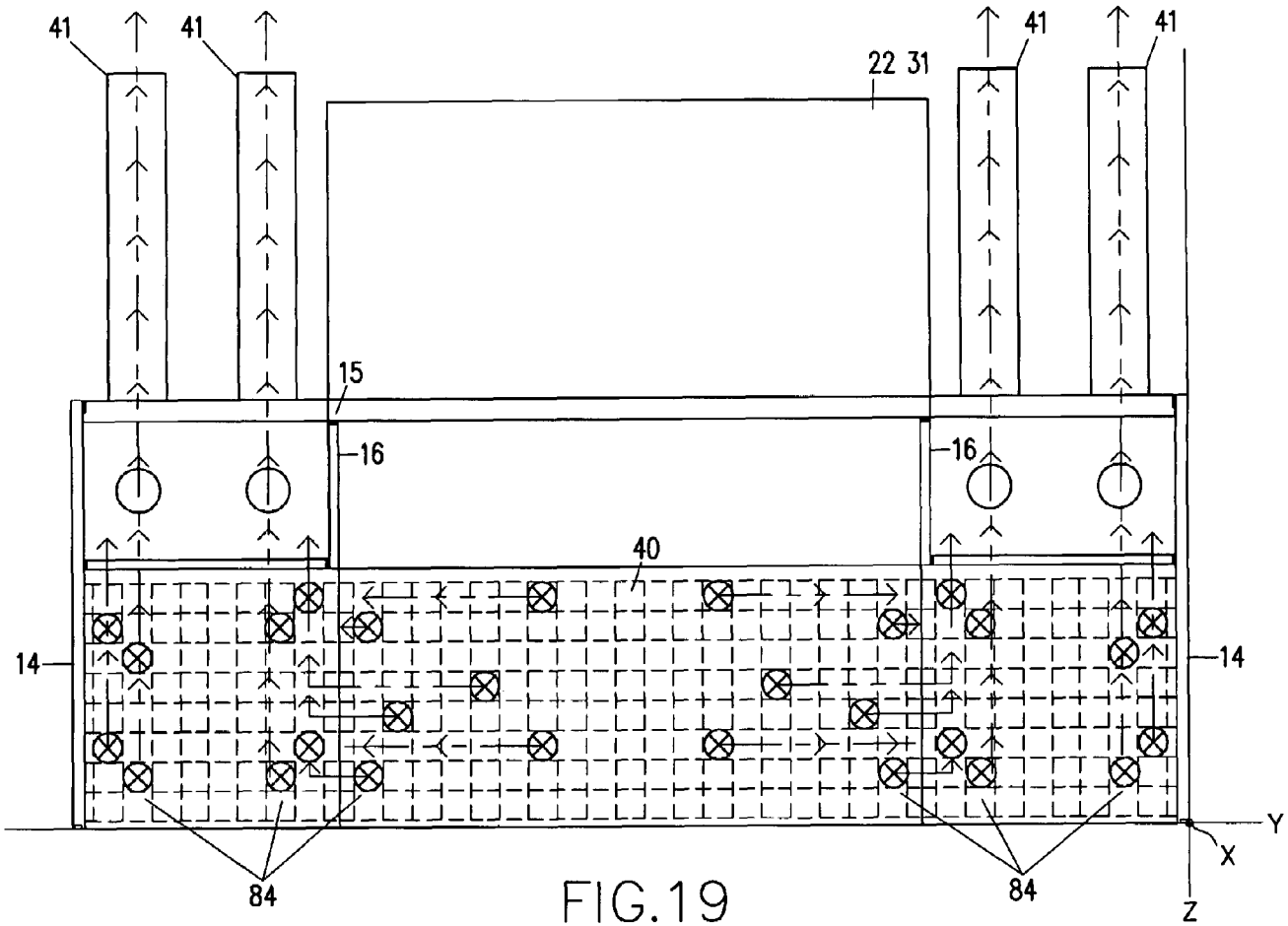
FIG. 19 is a diagrammatic sectional front view type depiction of the paint booth arrangement with air exhaust portion of the air intake-exhaust complex replaced to show the generalized airflow exhaust and recirculation in three dimensions.
Figure 20:
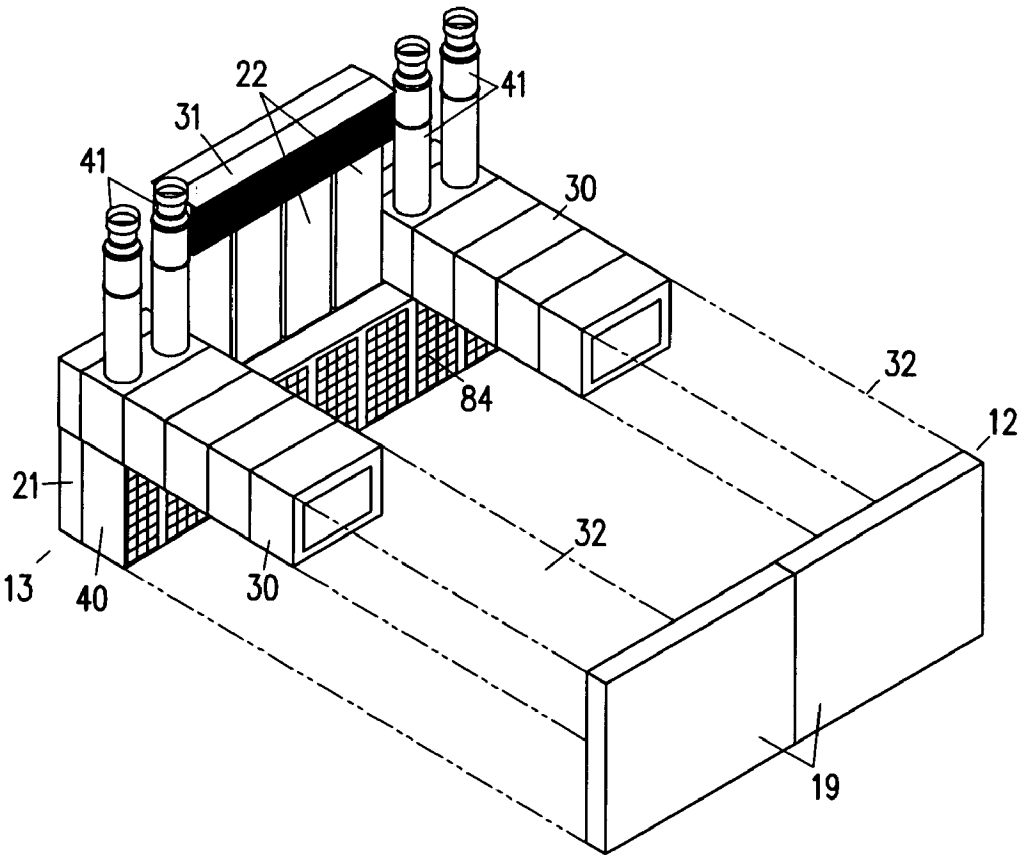
FIG. 20 is a diagrammatic top perspective type depiction of the structure otherwise shown in FIG. 13 with phantom ductwork extending to plenum filter doors at the forward section of the paint booth arrangement.
Figure 21:
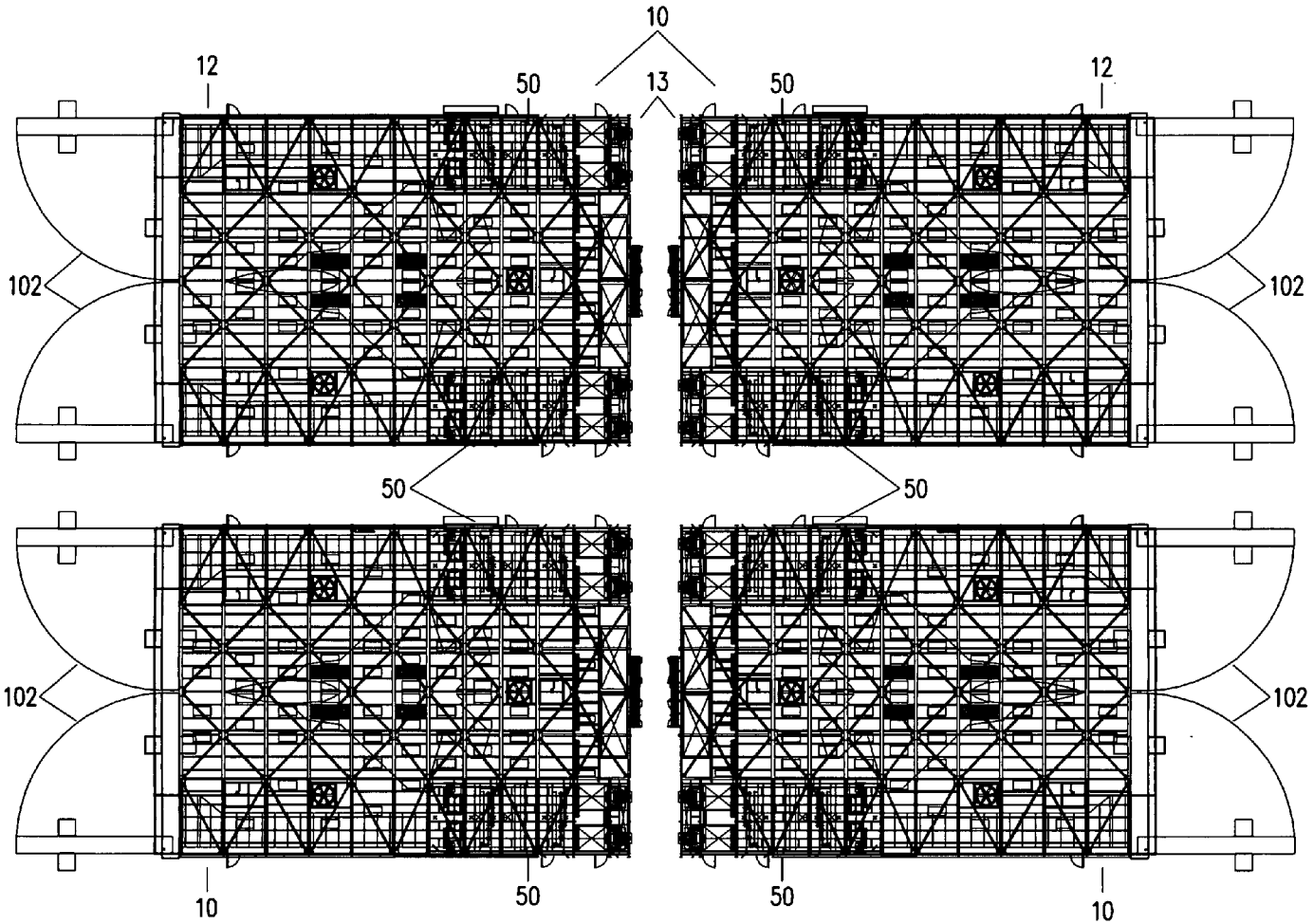
FIG. 21 is a diagrammatic type plan type depiction of four paint booth arrangements situated in side by side and back to back relation as a means to illustrated spatial relationship of centralized maintenance areas of such a system of booths.

Air from the open space of the booth enters the complex 40 via inlet filters 84 and exits the complex 40 via laterally opposed complex outlets 85. The exhaust assembly may further comprise exhaust ducts 41 preferably outfitted with reducer couplings, and fan stands with exhaust fans housed therewithin (fan assemblies not specifically illustrated) for further enhancing exhaust of airflows traversing and laterally dividing through the complex 40 as generally depicted in FIG. 19. From a further inspection of the drawings, it should be noted that the ducts 41 are assembled in communication with the energy recovery cell sections 25 so that energy may be recovered from exhausting airflows. Certain filter monitoring kits 42 may be further associated with or outfitted upon the complex 40 as referenced in FIG. 3.

Figure 4A:
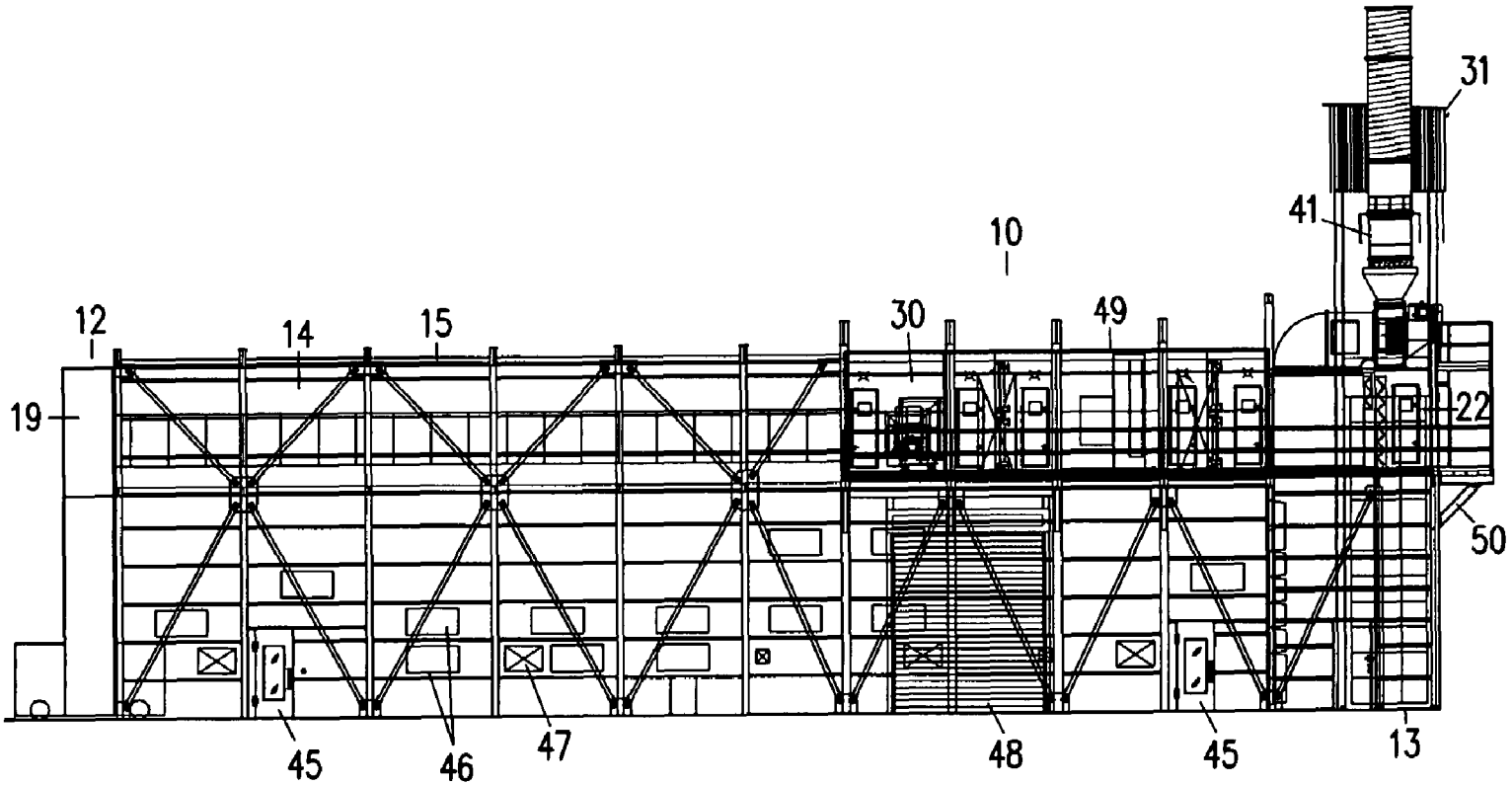
FIG. 4(*a*) is a detailed right side elevational type depiction of the paint booth arrangement according to the present invention.
Figure 4B:
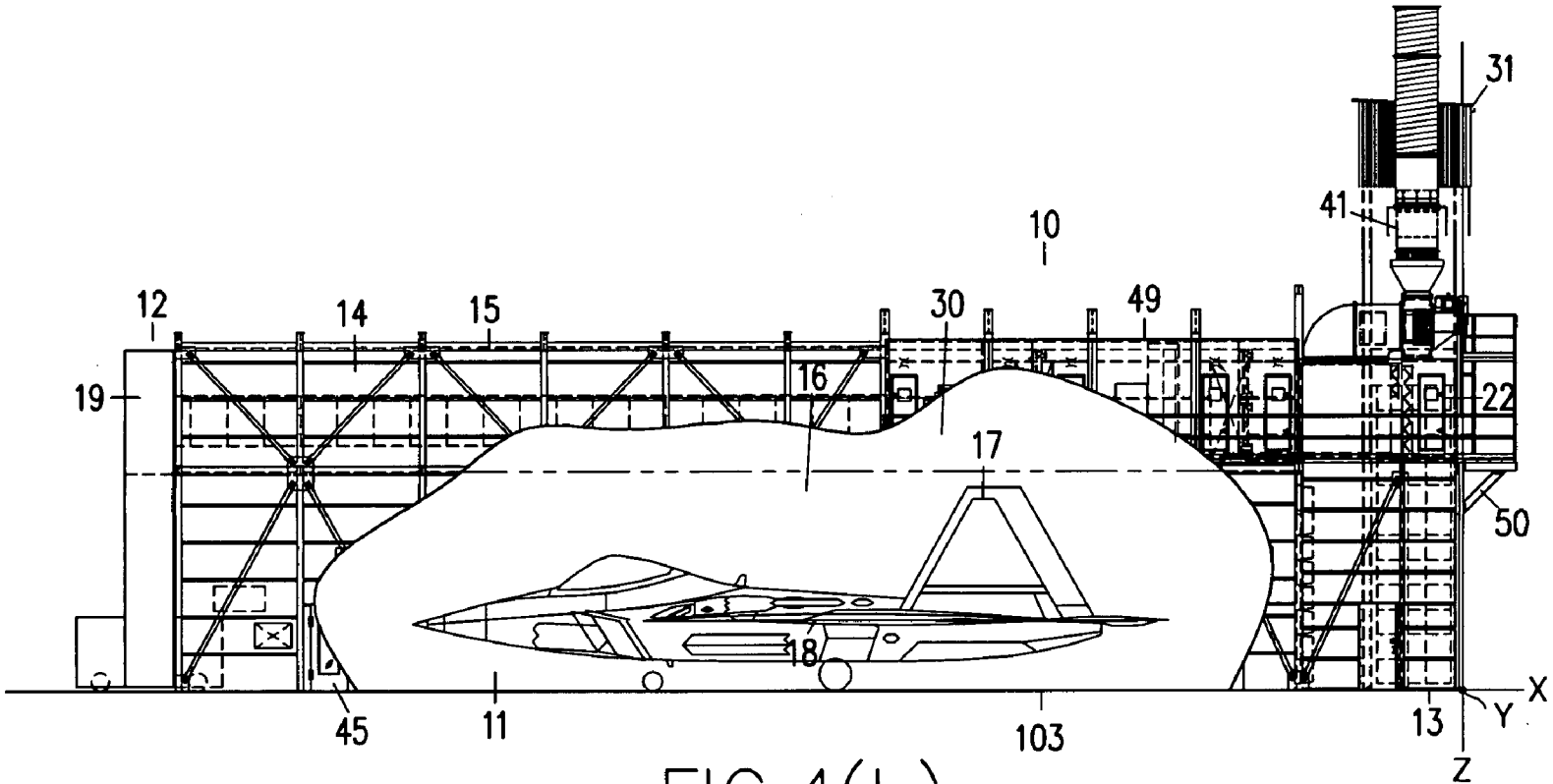
Figure 5A:
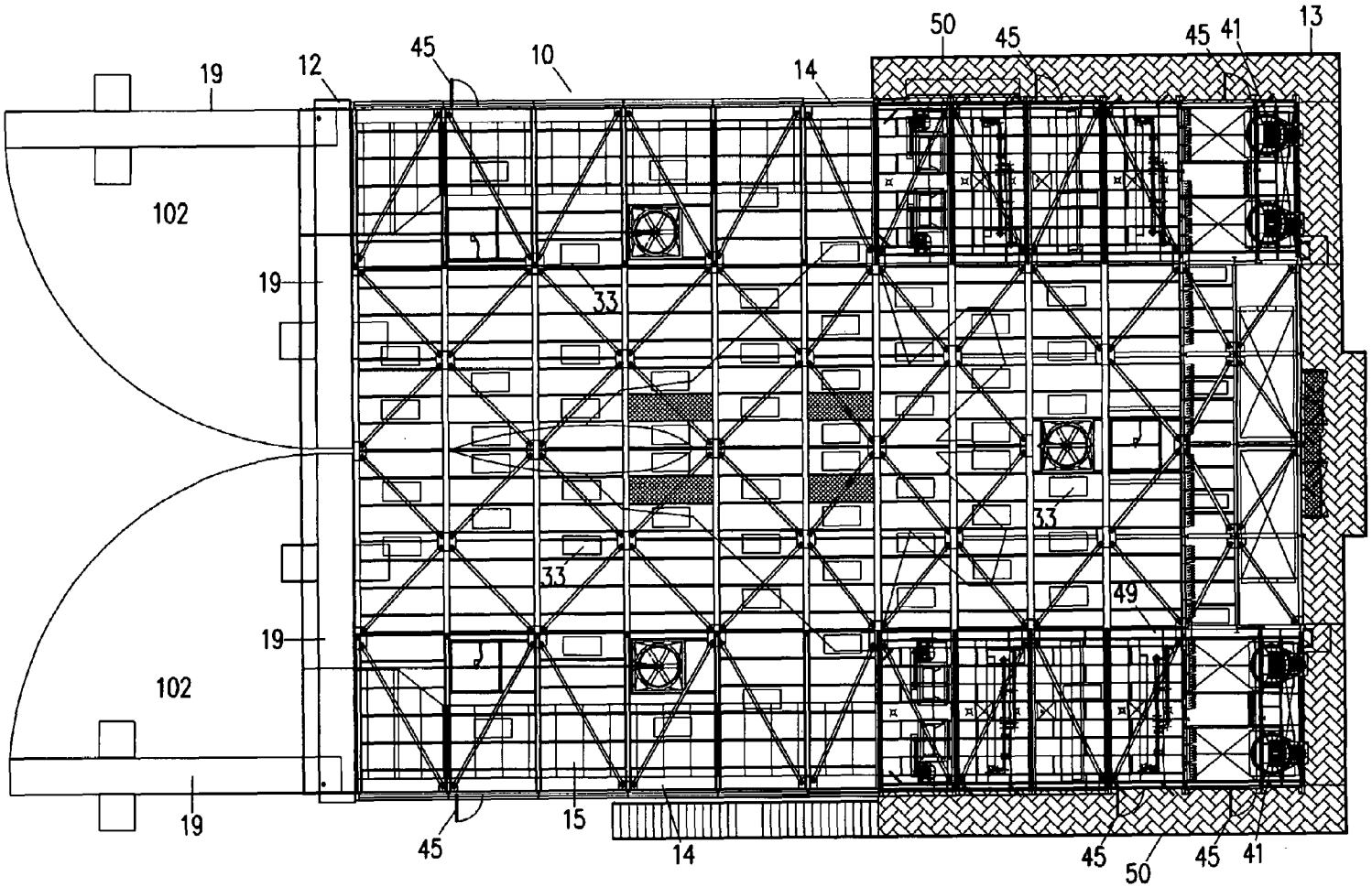
FIG. 5(*a*) is a detailed top plan type depiction of the paint booth arrangement according to the present invention.
Figure 5B:
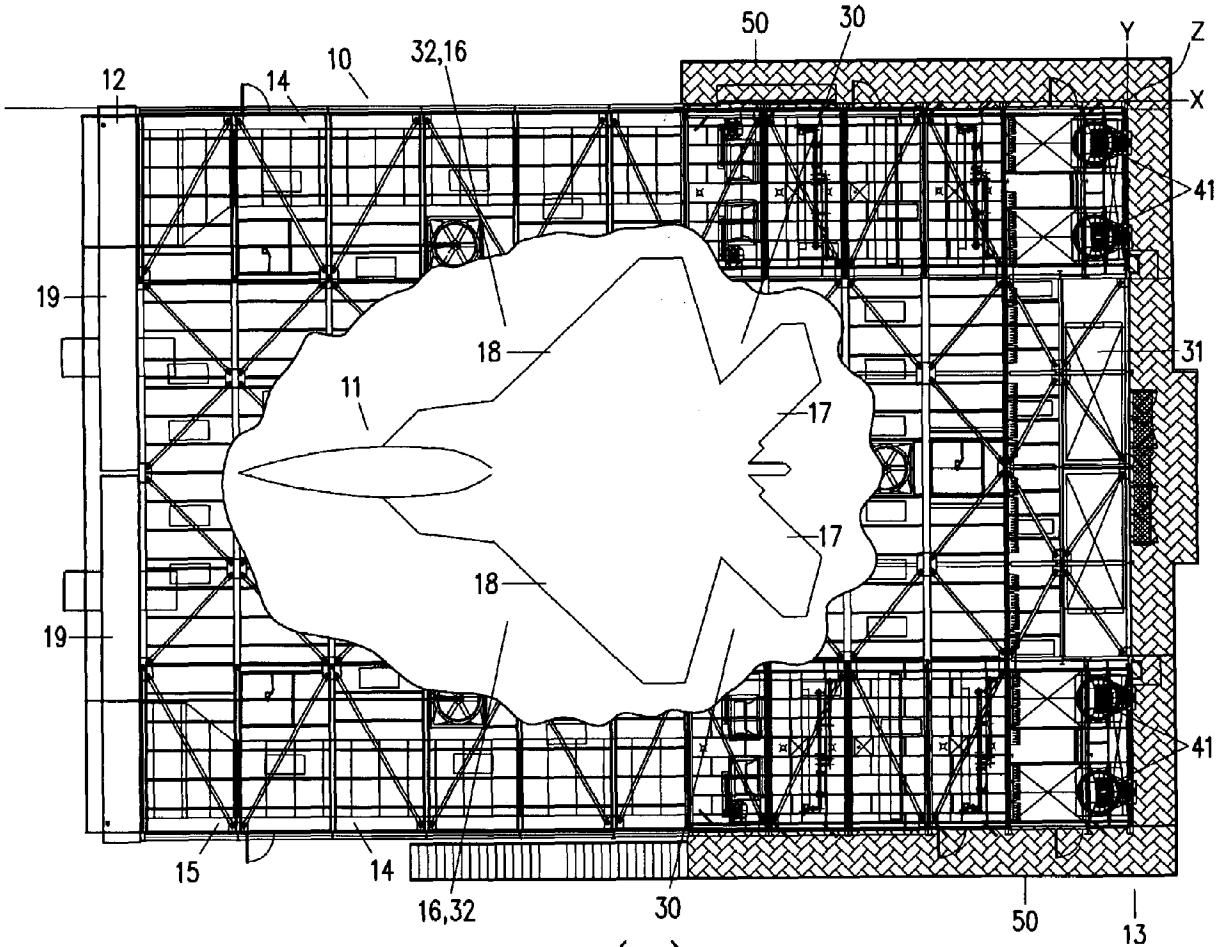
Figure 6:
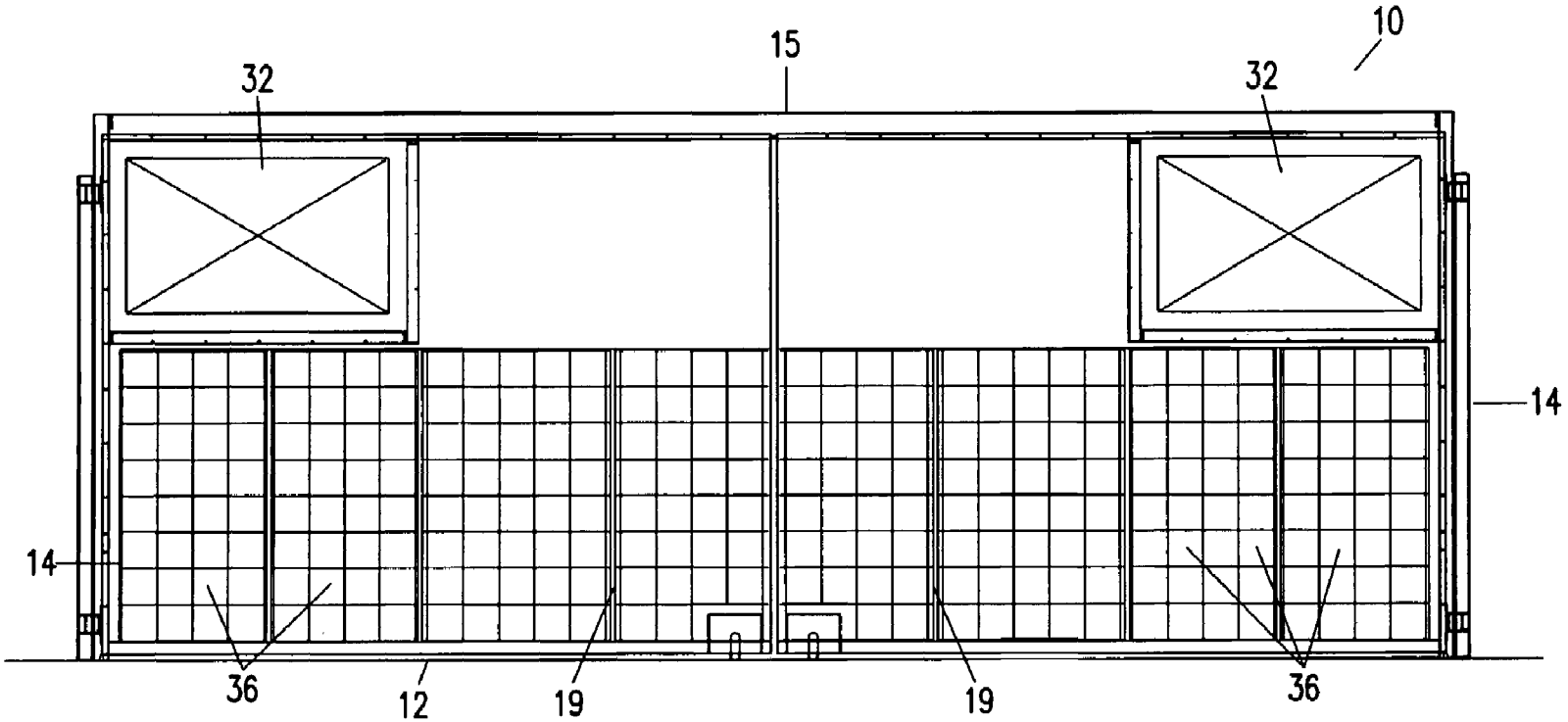
FIG. 6 is a detailed front elevational type depiction of the paint booth arrangement according to the present invention.
Figure 7:
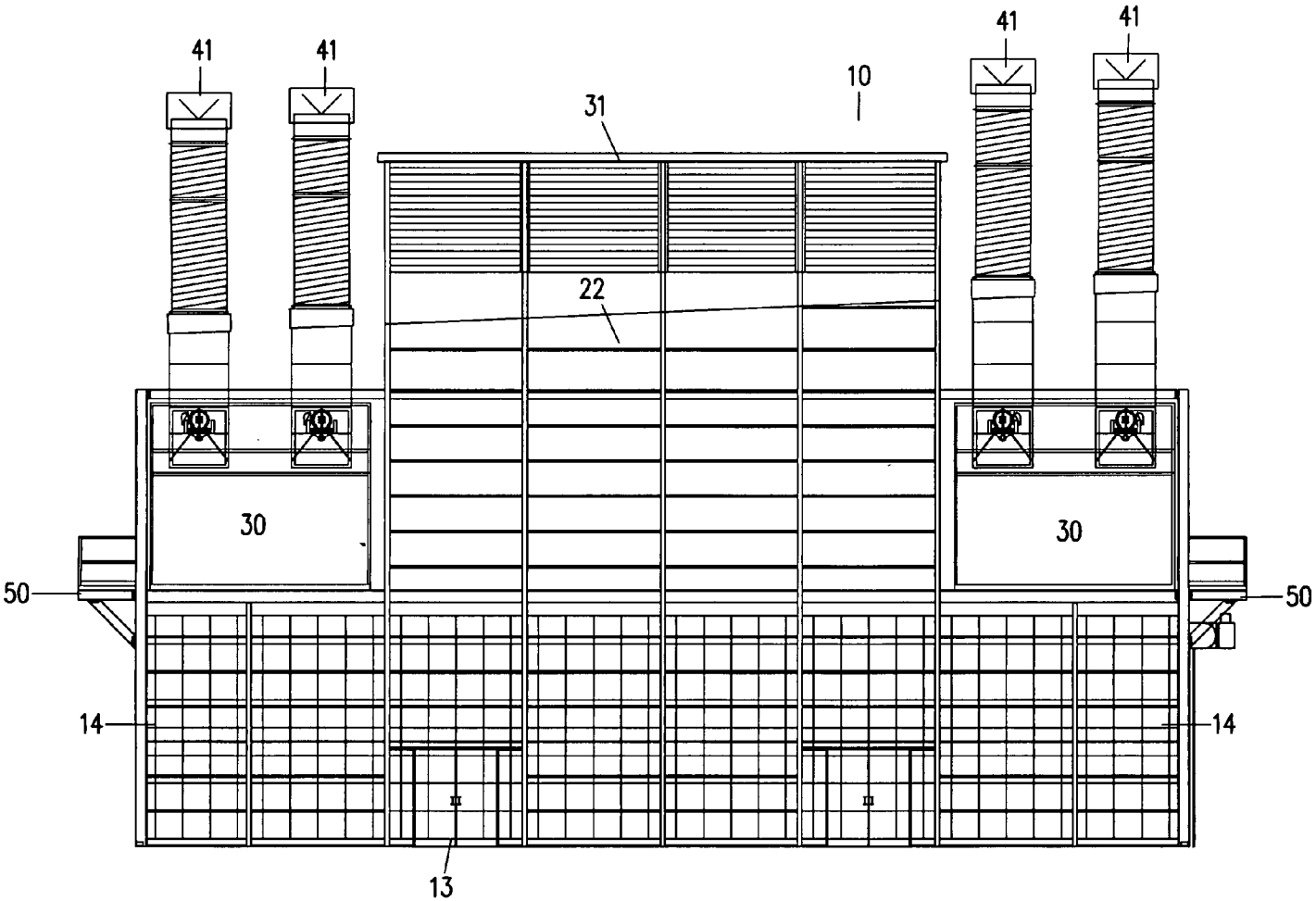
FIG. 7 is a detailed back elevational type depiction of the paint booth arrangement according to the present invention.
Figure 22:
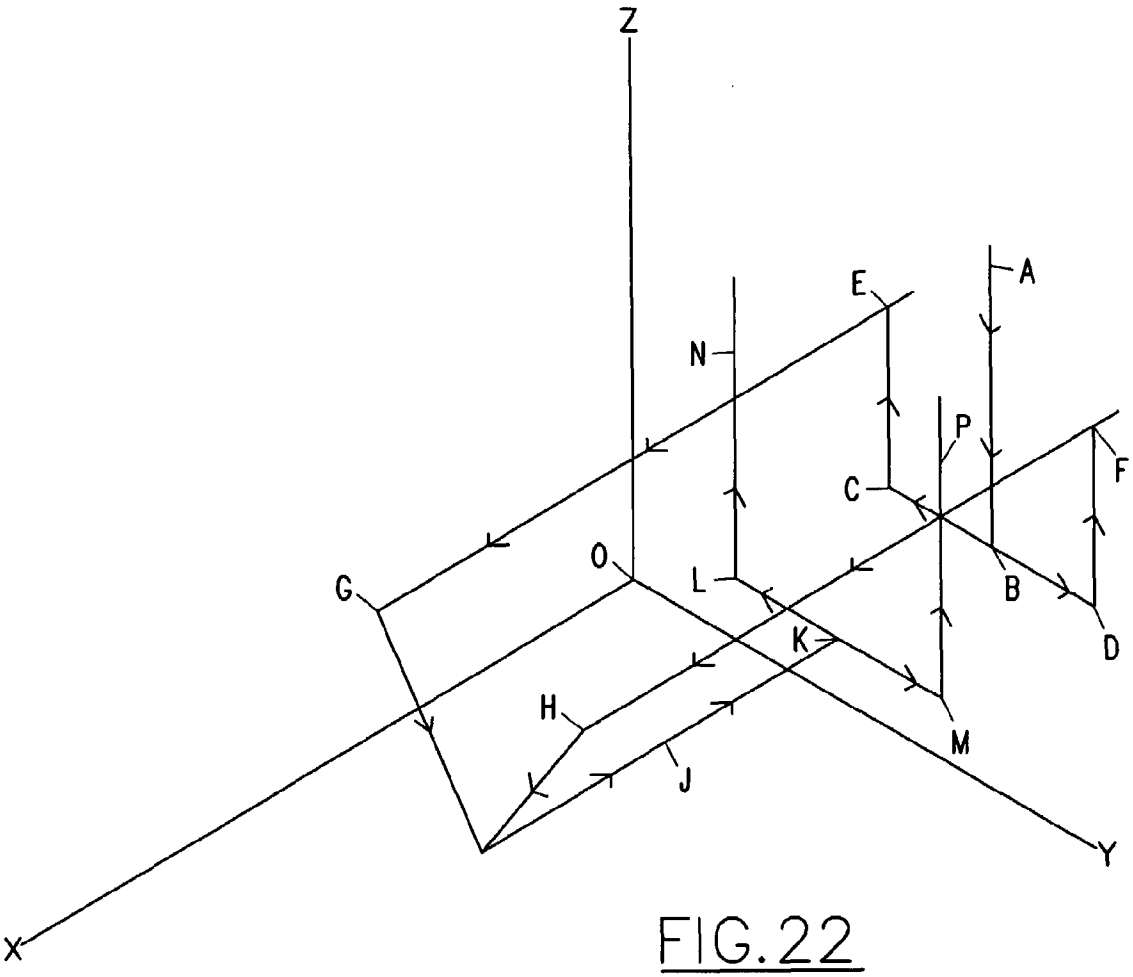
FIG. 22 is a perspective view of the generalized airflow paths through the paint booth arrangement as situated on a right-handed Cartesian coordinate system for clarity of comprehension.

The airflow through the arrangement 10 may perhaps be best described and/or illustrated by situating the arrangement 10 on a right-handed Cartesian coordinate system and highlighting the airflow paths therein with lines as generally depicted in FIG. 22. FIGS. 1, 2, 4(*b*), 5(*b*), 18, and 19 further reference the X, Y, and Z axes otherwise referenced in FIG. 22. With the junction intermediate the rearward section 13 and left lateral wall section 14 at ground level being placed at the Origin O: (0, 0, 0), it is contemplated that the forward section 12 may extend in a plane substantially parallel to the Y-Z plane and the four comers thereof may defined by four points in space, with (X, Y, Z) coordinates, as follows: (110, 0, 0); (110, 0, 30); (110, 80, 0); and (110, 80, 30) (FIG. 22 not being to scale). Assuming a divisible air packet enters the arrangement 10 via the centralized louvered penthouse 31 and descends ducts 22 (roughly in the negative Z direction in the Y-Z plane), the air packet may be said to enter the directional arrangement 10 at the point (0, 40, 30) as referenced at Point A.

Proceeding from Point A, the air packet descends to Point B within plenum 20 at point B: (0, 40, 20) where it divides laterally and progresses (in the positive and negative Y direction) into the left and right filter banks 21 to Points C and D: (0, 10, 20) and (0, 70, 20), respectively. The divided air packets then progress upwardly (in the positive Z direction) from the filter banks 21 into the left and right AMU's 30 to Points E and F: (0, 10, 25) and (0, 70, 25), respectively. The divided air packets then progress forwardly through the AMU's 30 and ductwork runs 32 (in the positive X direction) to Points G and H: (110, 10, 25) and (110, 70, 25), respectively.

Once in the plenum doors 19, the air packets may ideally merge at Point I: (110, 40, 15) and progress rearwardly through the open spaces 100 and 101 (of varied elevation). Note: as depicted, the merged/unified air packet(s) travel linearly through the open spaces 100 and 101 (in the negative X direction) for ease of illustration along line J extending intermediate Points I (10, 20, 15) and K (10, 20, 15). At Point K, within the exhaust filter complex 40, the air packet may be considered to divide once again and proceed (in the positive and negative Y direction) to Points L and M: (10, 10, 15) and (10, 70, 15).

From Points L and M, the exhausting air packets travel upwardly (in the positive Z direction) to Points N and P: (10, 10, 30) and (10, 70, 30), where the air packets exit the basic arrangement and enter the exhaust ducts 41 for further expulsion from the site. Comparatively referencing FIGS. 16 and 17, it may be seen that the airflow paths may proceed in the negative X direction (as at 110) after initially laterally dividing into a right path as at vector arrow 111 and into a left path as at vector arrow 112. It is contemplated that the airflow path may thus pass through a filter bank as at 44 in the noted figure as well as FIGS. 8 and 16-18.

The directional summary of airflow through the paint booth arrangement 10 is thus presented as achieved by way of the structures heretofore presented. It is contemplated that the present invention essentially teaches a paint booth arrangement for maximizing floor space and efficiency of a painting operation, which arrangement comprises an equipment enclosing structure and certain air handling equipment enclosed within said structure. The structure comprises a forward section as at 12 and a rearward section 13, opposed wall sections as at 14, a centralized roof section as at 15, and opposed wall-to-roof sections as at 16. The centralized roof or ceiling section 15 has a differing elevation than the wall-to-roof sections 16 and thereby defines certain centralized open space having varied elevation as compared to the open space defined by the wall-to-roof sections 16. The open spaces of varied height or elevation function or are adapted to receive specifically configured paintable equipment.

The air handling equipment according to the present invention comprises an air intake assembly, an air exhaust assembly, and an air replacement system. The air intake and air exhaust assemblies coextensively extend intermediate the wall sections 14 at the rearward section 13. The air replacement system comprises certain conduit extending intermediate the forward and rearward sections defined by the wall-to-roof sections 16, wall sections 14, and roof section 15. The air intake assembly is in communication with the conduit for directing inlet airflow to the open space(s) and the air exhaust assembly comprises certain means for exhausting airflow from the open space(s). Certain means for re-circulating exhausting airflow are further contemplated as generically or diagrammatically referenced at vector arrow(s) 120 in FIG. 19. In this regard, it is contemplated that state of the art (airflow) exhaust recirculating means may well be incorporated into the arrangement 10 and, being within the scope of ordinary skill of those in the art, no further description thereof is necessary.

The air intake assembly may preferably comprise certain means for filtering inlet airflow as may be exemplified by the filter banks 21 as laterally situated relative to a centralized plenum chamber 20. The forward section 12 may preferably comprise certain doorway bound plenum air intake sections, which sections may be preferably outfitted with certain means for filtering airflow directed therethrough and for enabling ingress and egress of paintable equipment. Notably, the paintable equipment may include aircraft 11 having centralized empennage sections 17 and opposed wing sections 18. The centralized roof section 15 is adapted for receiving the empennage sections 17 given its relative greater height and attendant open space, and the opposed lower roof sections are adapted for receiving the wing sections 16 given their relative lesser height.

The air replacement system of the arrangement 10 may preferably comprise an in-line energy recovery system for further enhancing air, climate, and efficiency of a painting operation. The air intake and air exhaust assemblies of the paint booth arrangement may provide certain load-bearing support for the air replacement system at the rearward section thereby together forming an air intake-exhaust support complex (the combination of complexes 40 and 70). The wall and upper roof sections support forward portions of the air replacement system intermediate the forward section and the air intake-exhaust support complex (or rearward sections). Should a plurality of paint booth arrangements be situated or constructed in side by side or back to back relation, it is contemplated that such an arrangement may well enable enhanced efficiency of maintenance procedures.

While the above description contains much specificity, this specificity should not be construed as limitations on the scope of the invention, but rather as an exemplification of the invention. For example, as is described hereinabove, it is contemplated that the present invention essentially discloses a paint booth for directing booth bound airflow through a space-saving booth arrangement, which paint booth comprises an enclosure and an intake-exhaust complex. The enclosure comprises a forward section, a rearward section, opposed wall sections, a roof assembly, and a transverse booth cross section. The transverse booth cross section defines open space adapted to receive paintable equipment and closed space adapted to direct airflow.

The intake-exhaust complex comprises an air intake assembly and an air exhaust assembly. The air intake and air exhaust assemblies preferably share a common wall and extend intermediate the wall sections adjacent the rearward section. The closed space extends intermediate the forward and rearward sections, and the air intake assembly communicates therewith for directing replacement airflow to the open space. The air exhaust assembly comprises certain means for exhausting airflow from the open space.

The roof assembly may comprise upper and lower roof sections such that the wall sections and upper and lower roof sections define the closed space. The forward section may preferably comprise certain doorway bound plenum air intake sections in communication with the closed space, which plenum air intake sections may be outfitted with certain means for filtering airflow directed through the air intake sections, and which enable ingress and egress of paintable equipment. The arrangement may comprise opposed lower roof sections and the paintable equipment may be defined by aircraft having empennage sections and opposed wing sections. The upper roof section thus functions to receive the empennage sections and the lower roof sections function to receive the wing sections.

In addition to the foregoing structural considerations, it is further believed that the inventive concepts discussed support certain new methods and/or processes for directing airflow through a paint booth. In this regard, it is contemplated that the detailed specifications support a certain process for directing paint booth airflows, which directed airflows may well function to enhance operational efficiency of a paint booth operation. The process may be said to comprise a series of steps as perhaps most clearly reflected in FIG. 22, and as supported by the structures and depictions in the remaining illustrations.

The steps may thus be said to include downwardly directing centralized airflow from the louvered penthouse 31 through the ducts 22 and into the plenum chamber 20 as reflected by the displacement from Point A to Point B. Fresh air is thus inlet adjacent a lower portion of the first paint booth end or rearward section 13 within the plenum chamber 20 thereby forming centralized, inlet airflow. The centralized, inlet airflow is thereafter laterally divided and directed toward laterally opposed portions of the paint booth as depicted by displacements from Point B to Points C and D thereby forming a laterally divided and directed airflow.

The laterally divided and directed airflow is thereafter upwardly directed toward lower and upper roof portions (e.g. wall-to-roof sections 16 and roof section 15) adjacent the first paint booth end or rearward section 13 as reflected in airflow displacements from Points C and D to Points E and F, respectively. The laterally divided airflow is thereafter longitudinally directed in the space defined by the lower and upper roof portions or intermediate the lower and upper roof portions toward a second paint booth end or forward section 12. While being directed longitudinally, the airflow may be enhanced (as, for example, via the blower section 29) and conditioned (as, for example, via the sections 26-28). Further, energy may be recovered from the airflow as it travels through the energy recovery cell section 25 or similar other means.

The laterally divided and longitudinally directed airflow may thereafter be filtered and/or conducted via the plenum doors 19 (or booth merged via lower roof portions) at the second booth end into booth bound open space(s) 100 and 101. The booth merging airflow (having centralized and downward directions) as at Points G, H, and I, enters the open space(s) 100 and 101, and is longitudinally directed within the booth bound open space toward lower portions of the first paint booth end or rearward section 13 as reflected at vector/line J. Upon reaching the lower portions of the first paint booth end, the airflow may be filtered via the complex 40; laterally divided as from Point K to Points L and M, which laterally divided exhausting airflow is exhausted in lateral adjacency to centrally inlet fresh air. Notably, the booth merged airflow may be upwardly exhausting adjacent the first paint booth end such that the net displacement during a full cycle through the arrangement 10 is the minimized distance between the louvered penthouse 31 and the ducts 41.

Although the invention has been described by reference to certain preferred embodiment(s) and certain methodology, it is not intended that the novel arrangement and method for directing paint booth airflows be limited thereby, but that modifications thereof are intended to be included as falling within the broad scope and spirit of the foregoing disclosures and the appended drawings.

I claim:

1. A horizontal draft paint booth arrangement for maximizing floor space and efficiency of a painting operation, the horizontal draft paint booth arrangement comprising:

an equipment enclosing structure, said structure comprising an open interior space, the interior space having a transverse, horizontal-drafting area and being defined by forward and rearward sections, opposed wall sections, a centralized roof section, opposed duct-defining, wall-to-roof sections, and a ground support structure, the duct-defining, wall-to-roof sections minimizing the interior space at the roof and wall sections, the transverse horizontal-drafting area for receiving paintable equipment having vertical and horizontal components of varied dimensions, the transverse horizontal-drafting area being minimized relative to the varied dimensions; and air handling equipment, said equipment comprising an air intake assembly, an air exhaust assembly, and an air replacement system, the air intake and exhaust assemblies coextensively extending intermediate the wall sections at the rearward section, the air replacement system comprising conduit extending intermediate the forward and rearward sections in line with the duct-defining, wall-to-roof sections, the air intake assembly being in communication with the conduit for directing inlet airflow to the forward section, the forward section comprising doors, said doors having supply plenums extending intermediate the roof section and ground support structure for (1) receiving conduit-conducted airflow from the conduit, (2) channeling received airflow downward toward the ground support structure, and (3) outletting downwardly channeled airflow to the transverse horizontal-drafting area such that the outlet airflow flows parallel to and opposite the conduit-conducted airflow within the interior space, the air exhaust assembly comprising means for exhausting horizontally-drafted airflow from the interior space.

2. The paint booth arrangement of claim 1 wherein the air intake assembly comprises means for filtering inlet airflow.

3. The paint booth arrangement of claim 1 wherein the forward section comprises means for filtering airflow.

4. The paint booth arrangement of claim 3 wherein said doors enable ingress and egress of paintable equipment.

5. The paint booth arrangement of claim 1 wherein the paintable equipment comprises aircraft and the transverse horizontal-drafting area is invertedly T-shaped, the aircraft having centralized empennage sections and opposed wing sections, the duct-defining, wall-to-roof sections and the centralized roof section together being adapted for receiving said empennage sections, the opposed duct-defining, wall-to-roof sections and the wall sections together being adapted for receiving said wing sections.

6. The paint booth arrangement of claim 1 wherein the air intake and exhaust assemblies support the air replacement system at the rearward section thereby forming an air intake-exhaust support complex.

7. The paint booth arrangement of claim 1 wherein the air replacement system comprises an in-line energy recovery system.

8. The paint booth arrangement of claim 6 wherein the wall and roof sections structurally support portions of the air replacement system intermediate the forward section and the air intake-exhaust support complex.

9. The paint booth arrangement of claim 1 comprising a plurality of equipment enclosing structures outfitted with air handling equipment, each outfitted structure being arranged such that the rearward sections oppose one another thereby enabling enhanced efficiency of maintenance procedures.

10. The paint booth arrangement of claim 1 wherein the air exhaust assembly comprises means for re-circulating exhausting airflow.

11. A horizontal draft paint booth for directing horizontally drafted airflow through a space-saving booth arrangement, the horizontal draft paint booth comprising:

an enclosure, the enclosure comprising forward and rearward sections, opposed wall sections, a roof assembly, a ground support structure, and a rectangular transverse booth cross section, the transverse booth cross section defining (1) an irregularly shaped open space adapted and conformed to (a) receive paintable equipment having vertical and horizontal components of varied dimensions, and (b) minimize the horizontal-drafting area relative to the varied dimensions, and (2) a closed space adapted to direct airflow orthogonal to the minimized horizontal-drafting area in a first direction;

an intake-exhaust complex, said complex comprising an air intake assembly and an air exhaust assembly, the air intake and exhaust assemblies extending intermediate the wall sections adjacent the rearward section, the closed space extending intermediate the forward and rearward sections, the air intake assembly being in communication with the closed space for directing replacement airflow to the forward section, the forward section comprising doors having supply plenums extending intermediate the roof section and ground support structure for (1) receiving closed space-conducted airflow from the closed space, (2) channeling received airflow downward toward the ground support structure, and (3) outletting downwardly channeled airflow to the horizontal-drafting area such that the outlet airflow flows parallel to the closed space-conducted airflow within the open space in a second direction opposite the first direction, the air exhaust assembly comprising means for exhausting airflow from the open space.

12. The paint booth of claim 11 wherein the roof assembly comprises upper and lower roof sections, the wall sections and upper and lower roof sections defining the closed space.

13. The paint booth of claim 11 wherein the air exhaust assembly comprises means for filtering paint overspray from exhausting airflow.

14. The paint booth of claim 11 wherein the supply plenums at the forward section are outfitted with means for filtering airflow directed therethrough.

15. The paint booth of claim 14 wherein the supply plenums enable ingress and egress of paintable equipment.

16. The paint booth of claim 11 comprising opposed lower roof sections, the paintable equipment comprising aircraft, the aircraft having empennage sections and opposed wing sections, the open space at the upper roof section for receiving said empennage sections and the open space at the lower roof sections for receiving said wing sections.

17. The paint booth of claim 11 comprising air handling means in line with the closed space for enhancing and conditioning airflow through the paint booth.

18. The paint booth of claim 17 wherein the air handling means comprise energy recovery means for recovering and utilizing energy from passing airflow.

19. The paint booth of claim 17 wherein said complex structurally supports said air handling means.

20. The paint booth of claim 11 wherein the air exhaust assembly comprises means for re-circulating exhausting airflow.

21. A process for directing paint booth airflows, the process for maximizing floor space and enhancing operational efficiency, the process comprising the steps of:

upwardly directing laterally divided inlet airflow toward lower and upper roof portions at a first paint booth end within a rearward wall-bound space;

longitudinally directing the laterally divided airflow intermediate lower and upper roof portions toward a second paint booth end in a first direction;

downwardly directing the laterally divided airflow into plenums defined by doors extending intermediate the lower and upper roof sections and a ground support structure at a second paint booth end opposite the first booth end;

outletting airflow from the plenums into booth bound open space in a second, horizontal-drafting direction parallel to and opposite the first direction; and horizontally drafting airflow within the booth bound open space toward the first paint booth end, the horizontally drafting airflow being orthogonal to the laterally divided inlet airflow.

22. The process of claim 21 comprising a series of steps before upwardly directing laterally divided airflow, the steps including:

centrally inletting fresh air adjacent a lower portion of the first paint booth end thereby forming a centralized, inlet airflow;

laterally dividing the centralized inlet airflow thereby forming a laterally divided airflow; and laterally directing the laterally divided airflow toward laterally opposed portions of the paint booth.

23. The process of claim 21 comprising the step of exhausting horizontally drafted airflow trough a vertically extending space intermediate the rearward wall-bound space and the booth bound open space.

24. The process of claim 23 comprising the step of filtering horizontally drafted airflow before exhausting said airflow.

25. The process of claim 24 comprising the step of laterally dividing the horizontally drafted airflow before exhausting said airflow, the laterally divided exhausting airflow being exhausted in lateral adjacency to centrally inlet fresh air.

26. The process of claim 23 comprising the step of recovering energy from the exhausting airflow.

27. The process of claim 23 comprising the step of re-circulating exhausting horizontally drafted airflow.

28. The process of claim 22 comprising the step of filtering the laterally divided airflow before upwardly directing the laterally divided airflow.

29. The process of claim 21 comprising the steps of enhancing and conditioning the airflow while longitudinally directing the airflow intermediate the lower and upper roof portions.

30. The process of claim 29 comprising the step of recovering energy from the airflow while longitudinally directing the airflow intermediate the lower and upper roof portions.

* * * * *